US010580234B2

(12) United States Patent
Dillow

(10) Patent No.: US 10,580,234 B2
(45) Date of Patent: Mar. 3, 2020

(54) VEHICLE DOCUMENTATION SYSTEM

(71) Applicant: ADESA, INC., Carmel, IN (US)

(72) Inventor: Christopher Dillow, Carmel, IN (US)

(73) Assignee: ADESA, Inc., Carmel, IN (US)

( * ) Notice: Subject to any disclaimer, the term of this patent is extended or adjusted under 35 U.S.C. 154(b) by 101 days.

(21) Appl. No.: 15/875,276

(22) Filed: Jan. 19, 2018

(65) Prior Publication Data

US 2018/0211455 A1 Jul. 26, 2018

Related U.S. Application Data

(60) Provisional application No. 62/448,666, filed on Jan. 20, 2017.

(51) Int. Cl.

| | |
|---|---|
| ***G07C 5/12*** | (2006.01) |
| ***G06Q 30/08*** | (2012.01) |
| ***G07C 5/00*** | (2006.01) |
| ***G07C 5/08*** | (2006.01) |

(52) U.S. Cl.

CPC ..... *G07C 5/12* (2013.01); *G06Q 30/08* (2013.01); *G07C 5/008* (2013.01); *G07C 5/0866* (2013.01)

(58) Field of Classification Search

CPC ..... G07C 5/12; G07C 5/008; G07C 5/0886; G06C 30/08

See application file for complete search history.

(56) References Cited

U.S. PATENT DOCUMENTS

| | | | | |
|---|---|---|---|---|
| 4,839,562 | A | 6/1989 | Francis et al. | |
| 5,335,041 | A | 8/1994 | Fox | |
| 6,118,230 | A | 9/2000 | Fleischmann | |
| 6,831,996 | B1 | 12/2004 | Williams et al. | |
| 7,249,317 | B1 | 7/2007 | Nakagawa et al. | |
| 8,112,325 | B2 * | 2/2012 | Foy | G06Q 30/06 705/27.2 |
| 8,761,594 | B1 | 6/2014 | Gross et al. | |
| 2001/0020202 | A1 | 9/2001 | Obradovich et al. | |
| 2006/0048845 | A1 | 3/2006 | Slavin et al. | |

(Continued)

OTHER PUBLICATIONS

PCT International Search Report for corresponding Patent Cooperation Treaty Application No. PCT/US2015/048488 dated Nov. 27, 2015, 2 pages.

(Continued)

*Primary Examiner* — Kim Y Vu
*Assistant Examiner* — Molly Delaney
(74) *Attorney, Agent, or Firm* — Lempia Summerfield Katz LLC

(57) ABSTRACT

A distributed vehicle documentation system uses multiple sensor systems to capture vehicle information and generate vehicle documentation. A sensor system may be a micro server in communication with a sensor and a control device. In response to requests from the control device, the sensor system may analyze images input in order to identify an object in the images, and modifying the images based on the identified object. For example, in response to identifying a wheel in an image, the image may be cropped in order to be centered around the identified wheel. In the event that the sensor system cannot identify the object (e.g., cannot identify the wheel in the image), another image may be obtained with a different field of view based on a determined size of the vehicle.

21 Claims, 11 Drawing Sheets

(56) References Cited

U.S. PATENT DOCUMENTS

2006/0114531 A1* 6/2006 Webb ..... G01N 21/8806 359/15
2007/0021883 A1 1/2007 Suggs
2007/0057815 A1* 3/2007 Foy ..... G06O 30/06 340/905
2008/0123809 A1* 5/2008 Tudor ..... G01V 5/0083 378/57
2008/0129844 A1 6/2008 Cusack et al.
2009/0138290 A1* 5/2009 Holden ..... G06Q 10/087 705/4
2009/0189981 A1 7/2009 Siann et al.
2009/0230894 A1 9/2009 De Goederen et al.
2010/0148919 A1 6/2010 Roberts et al.
2010/0238262 A1 9/2010 Kurtz et al.
2010/0256863 A1 10/2010 Nielsen et al.
2011/0197935 A1 8/2011 Belanger
2011/0211056 A1 9/2011 Publicover et al.
2011/0261217 A1 10/2011 Muukki et al.
2012/0154537 A1 6/2012 Chang et al.
2012/0324397 A1 12/2012 Patz et al.
2013/0038719 A1 2/2013 Canini et al.
2013/0162807 A1 6/2013 Bryll et al.
2014/0002254 A1 1/2014 Reuschel et al.
2014/0097251 A1 4/2014 Joussen et al.
2015/0036023 A1 2/2015 Gilbert
2016/0073061 A1 3/2016 Dillow

OTHER PUBLICATIONS

PCT Written Opinion of the International Searching Authority for corresponding Patent Cooperation Treaty Application No. PCT/US2015/048488 dated Nov. 27, 2015, 7 pages.

* cited by examiner

VEHICLE DOCUMENTATION SYSTEM

REFERENCE TO RELATED APPLICATION

This application claims the benefit of U.S. Provisional Application No. 62/448,666 filed on Jan. 20, 2017, the entirety of which is incorporated by reference herein.

TECHNICAL FIELD

This disclosure relates to a vehicle documentation system that uses multiple sensor systems to capture vehicle information and generate vehicle documentation.

BACKGROUND

With rapid advances in network connectivity, the landscape for sale of items at auctions, such as sale of vehicles at auctions has also changed. For example, in the past, potential bidders at vehicle auctions physically inspected a vehicle prior to valuating the vehicle and determining whether to place a bid and/or what bid to place for the vehicle. More recently, potential bidders have adopted reviewing information about the auction-items electronically, such as through a website, over the Internet or other network connection having computer or other display equipment. For example, potential bidders on a vehicle may review documentation, including mechanical details, history, accident reports, and other information along with images of the vehicle. Improvements to providing electronic documentation will facilitate further adoption of electronic review and bidding.

DETAILED DESCRIPTION

The discussion below makes reference to vehicle documentation booth to capture sensor data, such as images, of a vehicle. The vehicle documentation booth may be used for any documentation purpose, and may be particularly geared towards capturing images used in marketing, sales, or auction material for a vehicle. The vehicle documentation booth may be equipped with multiple sensor systems distributed within the booth structure, such as light-intensity sensors, vehicle position sensors, cameras, and dimmable lights. The sensors, lights, and other aspects of the vehicle documentation booth may be controlled by a control device, such as a handheld tablet computer, smartphone, desktop computer and any other such device. The control device may receive data from the sensor systems and in response may send instructions to some or all sensor systems in the booth.

For example, the control device may adjust intensity of the lights, request a particular camera to capture an image of the vehicle, store a captured image at a particular location on a storage device, and may populate a website with information associated with the vehicle. The control device may be equipped with sensor systems of its own. For example, the control device may be equipped with a camera that may be used to capture additional images of the vehicle, such as interior images of the vehicle. The images captured by the multiple cameras and the control device may be compiled together to create a collection of images used for marketing material for the vehicle. The control device may use a unique identifier of the vehicle, such as a Vehicle Identification Number (VIN) of the vehicle, to associate the captured images and other information for future use with the vehicle documentation.

Figure 1:
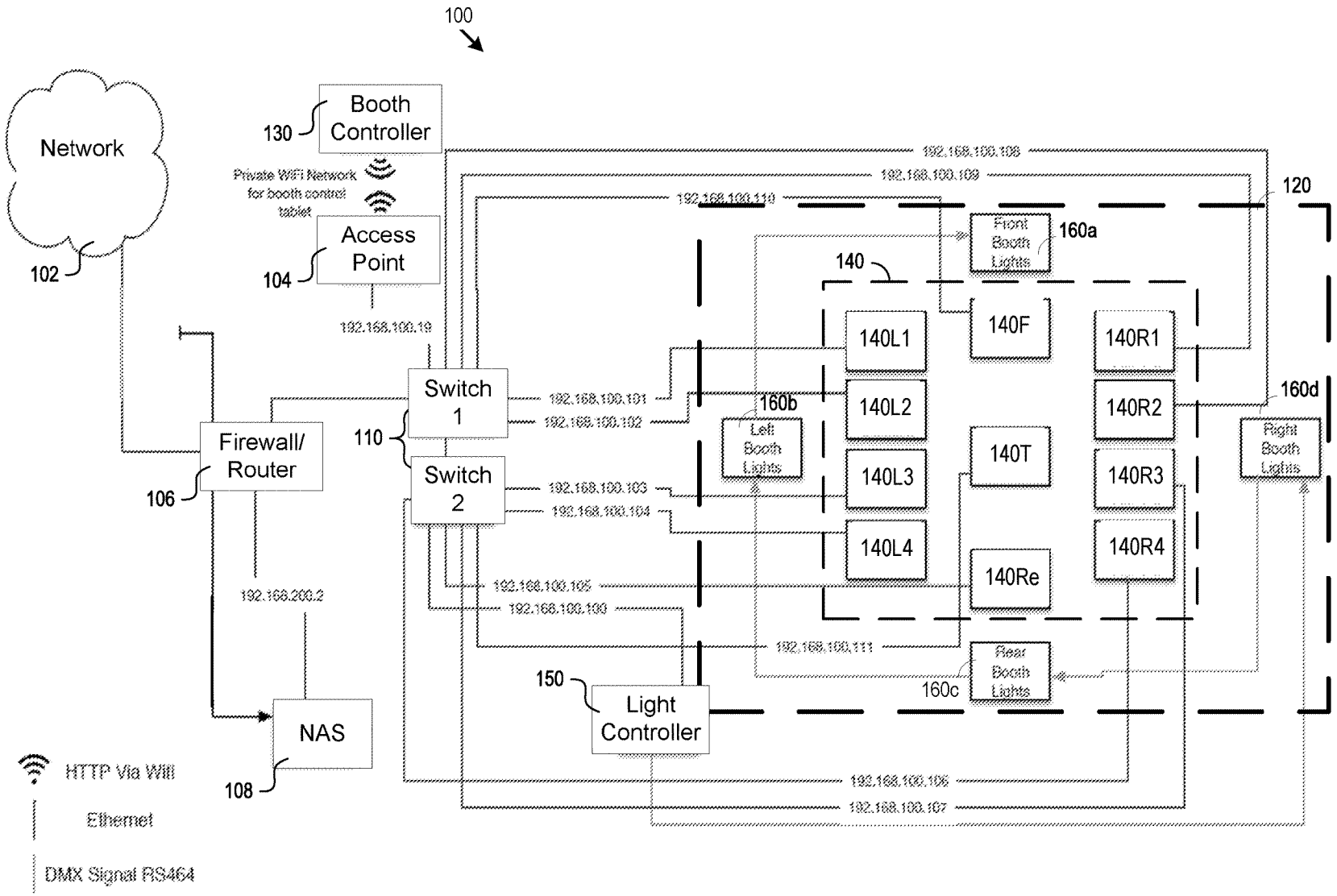
FIG. 1 shows an example vehicle documentation system.

FIG. 1 shows an example vehicle documentation system 100. The system 100 may include several network devices which interface with a network 102. The network devices may include an access point 104, a firewall/router device 106, a network attached storage device 108, and network switches 110. The system 100 may further include a vehicle documentation booth 120, a vehicle documentation booth controller device 130, multiple sensor systems 140, a light controller 150, and several lights 160*a-d*. The vehicle documentation system 100 may include other devices than those noted above.

The structure of the vehicle documentation booth 120 may be designed to be installed and withstand any selected environmental conditions where it is used, such as the conditions in place at a car dealership, storage lot, auction facility, or other location. As one example, the vehicle documentation booth 120 may be built from abrasion-proof material, such as Extruded T-Slot Aluminum. The design may be modular to facilitate shipment of the booth 120 as a prefabbed kit to the documentation site. The booth structure may provide mounting points for the sensor system 140 and lights 160 and a controlled environment for consistent capture of sensor system measurements.

The lights 160*a-d* may be single lights or groups of lights that are placed at predetermined locations within the vehicle documentation booth 120 to serve as illumination sources. The lights may be controllable lights that provide a varying illumination output, such as 30,000 Lumen Daylight Balanced Studio Photography LED Lights. The lights may be Digital Multiplex (DMX) controlled allowing on/off and dimming capability for each light. The booth 120 may include multiple lights at any predetermined locations. For example, the booth may include 16 lights, in controllable groups of four lights each at the locations indicated in FIG. 1: front booth lights 160*a*, left booth lights 160*b*, rear booth lights 160*c* and right booth lights 160*d*. The lights 160*a*, 160*b*, 160*c*, and 160*d* may be located to the front, left, rear, and right of a vehicle positioned within the booth 120. However, lights may be placed individually or in groups in any pre-determined locations within the booth 120 to facilitate capture of an image of the vehicle from a particular position. A controlled group of lights may be defined to include any selection of the individual lights. For example, two of the lights on the right, two from the left and one from the rear may be included in a group of lights when capturing an image using a camera positioned at the front of the vehicle documentation booth 120. Other groups of lights may also be configured.

Each group of lights 160*a-d* may include one or more lights. The intensity of a group as a whole or each individual light within the group may be adjusted. The intensity may be adjusted via commands from the booth controller 130, or the sensor systems 140 using a DMX protocol such as DMX512. Alternatively, or in addition, the DMX512 protocol commands to the lights 160 may be bridged to the booth network via a custom written web service that runs on one of the sensor systems 140.

The network 102 may be a local area network, a wide area network, or any other network that enables communication of data. The network 102 may include one or more devices that may interact with data captured and/or stored by the other components of the vehicle documentation system 100. For example, the network 102 may include a desktop computer, a laptop computer, or a mobile device such as a smart phone or tablet computer, that interacts with the data captured and/or stored by the other components of the vehicle documentation system 100. The data captured and/or stored by the other components of the vehicle documentation system 100 may be stored, for example, by the network attached storage device 108 or by the vehicle documentation booth controller device 130, or by any other device.

The network attached storage 108 may be a server device, such as a file server. The network attached storage 108 may include circuitry to store data in a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium. The storage medium in the network attached storage 108 may be setup to create large reliable data stores, for example by adopting a RAID standard such as RAID 2, RAID 5, or any other configuration. Alternatively, or in addition, the network attached storage 108 may be cloud data storage, provided by a third-party service provider, such as Amazon, Google, or any other data storage providers.

The firewall/router device 106 may involve circuitry and software to provide a network security system to control incoming and outgoing network traffic from the network 102 based on a rule set. The firewall/router may establish a barrier between the network 102 and what may be considered an internal network of the vehicle documentation system 100. The internal network may include the components communicable via the network created by the network access point 104. For example, the internal network may include vehicle documentation booth 120, the vehicle documentation booth controller device 130, the sensor systems 140, the light controller 150, the switch 110, and the network attached storage 108. The internal network may be, for example, a local area network such as an Ethernet network, and may involve wired or wireless communication. The access point 104 may be a wireless access point. The internal network may further include network devices such as switches 110, routers, and hubs to extend the internal network and provide the devices within the internal network a medium to communicate. The network devices may be enabled to provide Power over Ethernet (PoE), for example, the switches may be PoE switches.

The internal network (which may comprise transmission circuitry) enables the vehicle documentation booth controller device 130 to transmit and receive data to and from the other devices such as the sensor systems 140 and light controller 150. The vehicle documentation booth controller device 130, also referred to as a booth controller device 130, may transmit and receive data such as network request/response and light controller request/response. In this regard, the booth controller device 130 may act as a local server and may communicate with one or more remote servers (not shown) via access point 104 and network 102. In this regard, the booth controller device 130 may include a remote communication interface configured to communication with one or more remote servers. The network request/response may be a web service request/response, such as using hyper-text transfer protocol (HTTP), or any other network communication protocol. The light controller request/response may use protocols such as digital multiplex (DMX) to control the lights 160*a-d* via the light controller 150.

Figure 2:
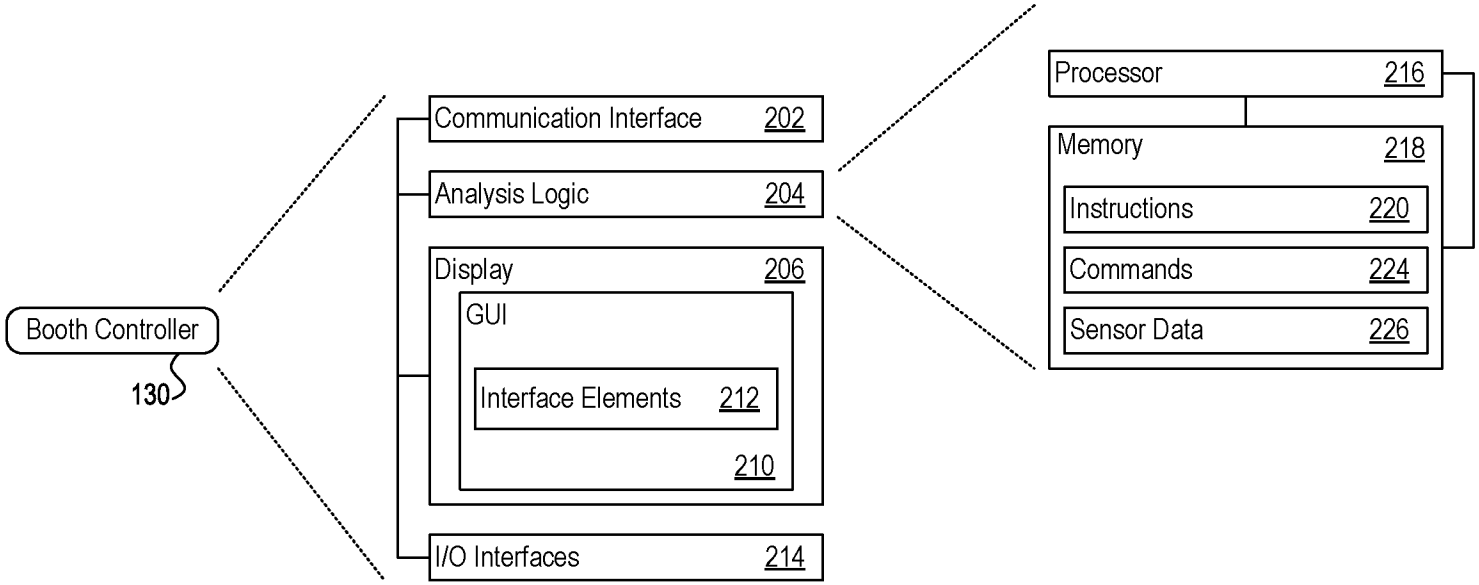
FIG. 2 shows an example booth controller device.

FIG. 2 shows an example booth controller device 130. The booth controller device 130 includes a communication interface 202, analysis logic 204, and a user interface 206. The communication interface 202 may include Universal Serial Bus (USB) interfaces, audio outputs, magnetic or optical media interfaces (e.g., a CDROM or DVD drive), network (e.g., Ethernet or cable (e.g., DOCSIS) interfaces), Serial Advanced Technology Attachment (SATA), and Peripheral Component Interconnect express (PCIe) interfaces and connectors, memory card slots or other types of serial, parallel, or network data interfaces. The communication interface 202 may include one or more Ethernet ports, or any other type of wired or wireless communication interface. For example, the communication interface 202 may include a communication interface for bi-directional communication of instructions/commands/data with the sensor systems 140, and light controller 150.

The user interface 206 may display, for example, a graphical user interface 210. The user interface 206 may display and accept user parameters, annotation commands, and display on the GUI 210 any type of vehicle documentation interface element 212. The interface element 212 may visualize, as just a few examples, images, light intensity level, or any other information or measurements captured by the sensor systems 140. The interface element 212 may also be directive interface element, such as a button, hyperlink, or any other interface element to provide a command or instruction to the system 100. For example, the interface element 212 may be an archival directive interface element that instructs one or more of the sensor systems 140 with an archival command to store captured information in the NAS 108. The user interface 206 may further present the information captured by the sensor systems 140 as an aggregated information portal, such as a web page. The captured information may be annotated with further information received from the NAS 108 or network 102, which the analysis logic 204 may request.

The input/output (I/O) interfaces 214 provide keyboard, mouse, voice recognition, touchscreen, and any other type of input mechanisms for operator interaction with the booth controller 130. Additional examples of the I/O interfaces 214 include microphones, video and still image cameras, temperature sensors, vibration sensors, rotation and orientation sensors, radiation sensors (e.g., IR or RF sensors), and other types of inputs.

The analysis logic 204 may include circuitry and software. In one implementation, the analysis logic 204 includes one or more processors 216 and memories 218. The memory 218 may store analysis instructions 220 (e.g., program instructions) for execution by the processor 216. The analysis logic 204 may include an application customized for mobile devices and operating systems, such as for Android, iOS, WebOS, Blackberry, or any other mobile device. This may allow any mobile device with the mobile application installed to effectively control the vehicle documentation system. The memory 218 may also hold the information received at the communication interface 202, such as sensor data 226 captured by the sensor systems 140. As will be described in more detail below, the analysis instructions may generate commands 224. The booth controller 130 may send the commands 224 to any network device whether within or external to the internal network. The commands 224, also referred to as requests, may cause the sensor systems 140 to be configured, capture information, store captured information, and transmit captured information to the booth controller device 130. The commands 224, in addition, or alternatively, may cause the lights 160*a-d* change intensity. Further, the commands 224 may change the way that a network device operates, request further annotation information from the network device, or cause any other adaptation. Some examples are described further below.

Further, the analysis logic 204 may include logic for analyzing sensor data 226 captured by sensor systems. As discussed in more detail below, one type of logic for analyzing sensor data 226 comprises computer vision, which may include processing and interpreting digital images (e.g., the extraction of data from the image in order to determine whether the image includes one or more markers). One type of computer vision comprises OpenCV (Open Source Computer Vision), which is a library of programming functions directed to real-time computer vision. One example function of OpenCV includes object identification, such as identification of circles (discussed in more detail below). Identification of other objects is contemplated. In response to identifying the object, the analysis logic 204 may modify the sensor data (e.g., crop the image to center the image on an identified object such as a wheel) and/or may tag the sensor data (e.g., the tag being indicative that the identified object is located within the image). Alternatively or in addition, the computer vision functionality may be resident in the sensor system, such as in analysis logic 306 in sensor system 300, discussed in further detail below.

The booth controller device 130 may generate commands to control operation of the sensor systems 140. In an example, as in the example system 100, the sensor systems 140 may include multiple sensor systems 140F, 140T, 140Re, 140L1-L4 and 140R1-R4. Other examples may include more or less sensor systems. The sensor systems 140 may be distributed across the vehicle documentation booth 120. The sensor systems may be placed at predetermined locations within the vehicle documentation booth 120. For example, the 140T sensor system, in the example system 100 may be located on a roof of the vehicle documentation booth 120 directed or oriented so as to capture sensory information of the vehicle. For example, the sensor system 140T may include a camera pointed towards the floor of the vehicle documentation booth 120 so as to capture an image of a vehicle in the vehicle documentation booth 120. Similarly, the sensor system 140F may be located at the front, 140Re at the rear, 140L1-L4 at the left and 140R1-R4 at right so as to capture information from the vehicle within the vehicle documentation booth 120. In one implementation, the sensor systems 140 include one or more image capture devices (such as one or more cameras). The sensor systems 140 are placed at predetermined locations within the vehicle documentation booth so as to capture information of the vehicle from various possible angles and orientations. For example, the sensor systems 140 may be placed in order to obtain a specific section of the vehicle, such as a predetermined side of the vehicle (e.g., left side or right side of the vehicle), a predetermined wheel of the vehicle (e.g., left front wheel, right front wheel, etc.) a predetermined portion of the vehicle (e.g., front bumper or rear bumper) or the like. Alternatively, the sensor systems 140 may be movable in response to commands 224 from the controller device 130. The sensor systems 140 may be translated or rotated in one, two and/or three dimensions using servo motors, gears, extending jack plates, conveyors, or any other such movable mechanical elements. In this regard, a respective sensor (e.g., a respective camera) may have a field of view associated therewith. For example, sensor system 140L1-L4 may have a field of view associated with the left side of the vehicle. As another example, sensor system 140R1-R4 may have a field of view associated with the right side of the vehicle.

Figure 3:
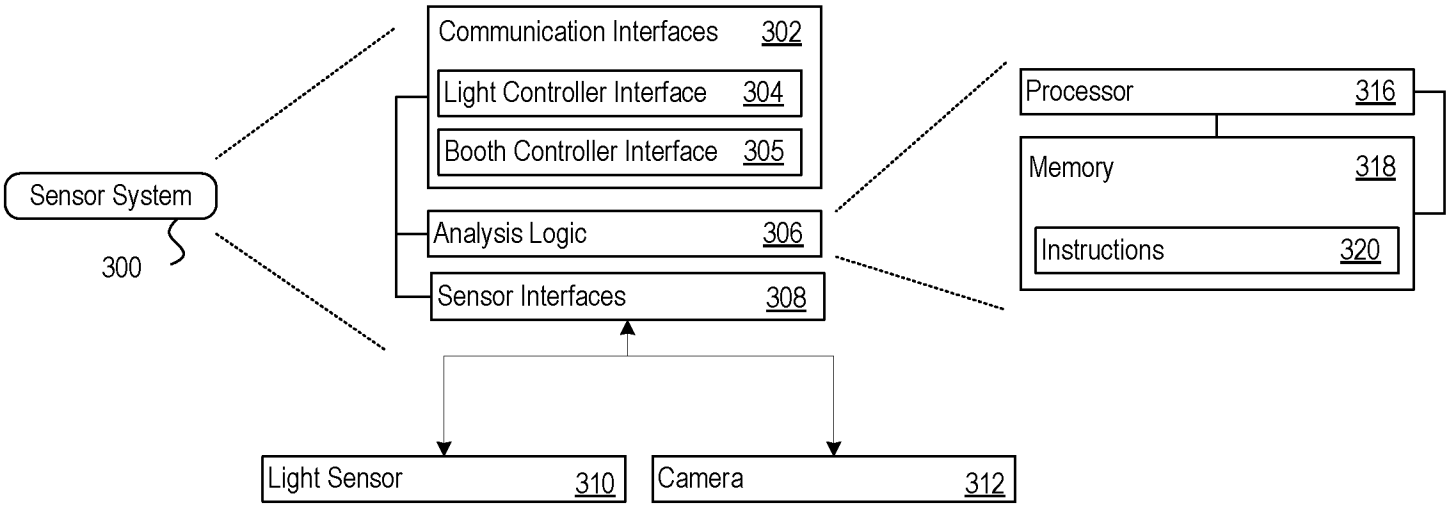
FIG. 3 shows an example sensor system.

FIG. 3 shows an example sensor system 300. The sensor system 300 may be any one of the sensor systems 140. The sensor system 300 may include, among other components, communication interfaces 302, analysis logic 306, and sensor interfaces 308. The sensor system 300 may be a webserver that receives requests for data from the other network devices in the vehicle documentation system 100. The sensor system 300 may, in response, acquire the requested data and transmit it back to the requesting device. The request and response communication may occur over wired or wireless communication. The communication may use protocols such as HTTP, secure HTTP (HTTPS) or any other format.

The examples above refer to cameras in the sensor systems for capturing images. However, any sensor system may include sensors of any type. For instance, a sensor system may include an audio sensor, e.g., a microphone, a video capture device, a thermal sensor, a vibration sensor, an infrared sensor, exhaust sensors, or a sensor for any other type of measurement. Accordingly, the booth 120 may capture sensor data for the vehicle across a wide variety of environmental characteristics to facilitate obtaining data to characterize the vehicle in many different ways, e.g., engine noise, or exhaust temperature and chemical composition.

For example, instead of using cameras controlled via the booth controller 130 as a central computer, the system 100 may implement a distributed architecture in which sensors, e.g., cameras, are included as part of any sensor system 300. The sensor system 300 may further include a computer system, such as a micro server, that receives instructions to capture an image from the booth controller 130. When a central computer directly communicates with the sensors, each sensor may transfer a captured image to the central computer via a protocol such as USB or 802.11 a/b/g/n/ac or the like.

In contrast, in the distributed architecture, each camera may be communicated with via a micro server. The distributed architecture facilitates control and coordination of a large collection of sensors via lightweight scripts such as Hyper Text Markup Language (HTML), JavaScript, and other combinations of scripting languages. For example, the sensor system may be a custom programmed all in one system on a chip board, such as a Raspberry PI, HummingBoard, Banana Pi, or any other system on a chip. The sensor system may operate using an operating system such as Linux, Odroid, Android, Windows RT, or any other operating system. The sensor system may be enclosed in a rugged case, such an aluminum case, to withstand the environmental conditions within the documentation booth 120. Each sensor system may be implemented as a web server, which responds to requests for images, such as web service protocol requests, or web service requests, such as HTTP requests. Instead of providing images that are stored in response to an HTTP request for an image, the sensor system may capture images using the equipped sensor, and transmit the captured image to the storage device. In addition, or alternatively, the sensor system may transmit a copy of a captured image to the requesting device. The response may be compliant with the web service request/response protocol.

FIG. 3 shows one example implementation of the sensor system 300. The communication interfaces 302 may include Universal Serial Bus (USB) interfaces, audio outputs, magnetic or optical media interfaces (e.g., a CDROM or DVD drive), network (e.g., Ethernet or cable (e.g., DOCSIS) interfaces), Serial Advanced Technology Attachment (SATA), and Peripheral Component Interconnect express (PCIe) interfaces and connectors, memory card slots or other types of serial, parallel, or network data interfaces. The communication interfaces 302 may include one or more Ethernet ports, or any other type of wired or wireless communication interface. For example, the communication interface may include a light controller interface 304 for bi-directional communication of instructions/commands/data with the light controller 150, and a booth controller interface 306 for bi-directional communication of instructions/commands/data with the booth controller 130.

The sensor interfaces 308 communicate with sensors that may be controlled by the sensor system 300. The sensors controlled by the sensor system 300 may be equipped to capture and/or measure sound, still image, video, vibration, heat, infrared light and various other physical conditions in the booth 120. Examples of the sensors include microphones, video and still image cameras, temperature sensors, vibration sensors, rotation and orientation sensors, radiation sensors (e.g., IR or RF sensors), and other types of sensors. FIG. 3 illustrates the sensor interfaces 308 capable to communicate with a light sensors 310 and camera 312 that may be controlled by the sensor system 300. For example, settings for the camera 312, such as orientation, zoom, pan, lens exposure level, macro mode, shutter time, may be controlled prior to using the camera to capture an image. Further, the intensity of the lights 160*a-d* in the vehicle documentation booth 120 may be controlled based on light intensity level measured by the light sensors.

The analysis logic 306 may process the commands 224 received at the communication interfaces 302 using the analysis instructions 320. The analysis logic 304 may, in turn, command the sensors via the sensor interfaces according to the commands 224. The analysis logic 304 may include circuitry and software. In one implementation, the analysis logic 304 includes one or more processors 316 and memories 318. The memory 318 may store the analysis instructions 320 (e.g., program instructions) for execution by the processor 316. The memory 318 may also hold the information received at the communication interface 302, and information captured at the sensor interfaces 308.

Alternatively, or in addition, the analysis logic 306 may include logic for analyzing sensor data captured by camera 312. One type of logic for analyzing sensor data 226 comprises computer vision, such as OpenCV. As discussed further below, the sensor data captured by camera 312 may be analyzed in order to identify one or more characteristics within the sensor data. In response to the identification, the analysis logic 306 may modify the sensor data (e.g., crop the image to center the image on an identified object such as a wheel) and/or may tag the sensor data (e.g, the tag being indicative that the identified object is located within the image).

Figure 4:
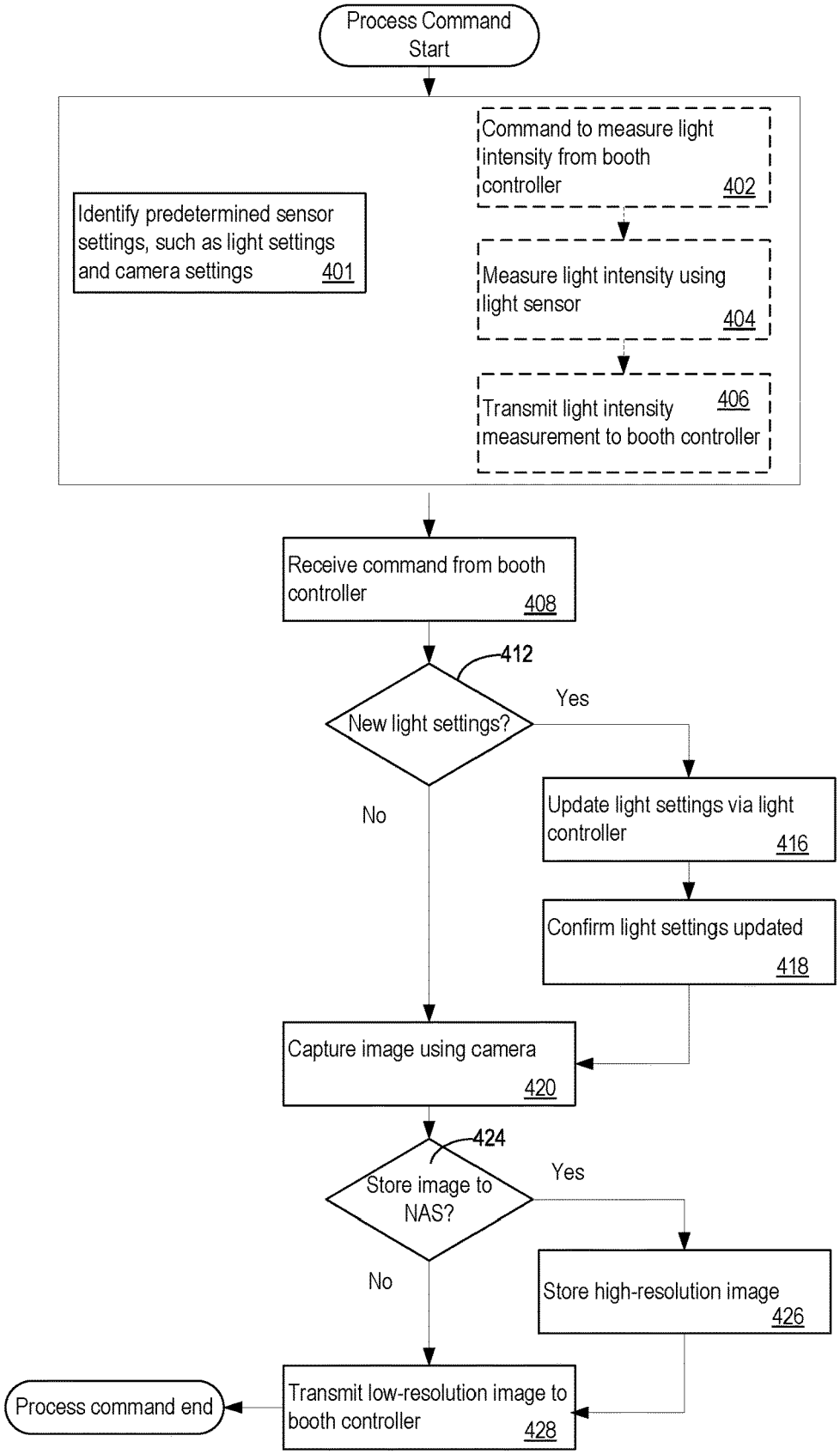
FIG. 4 shows example method performed by a sensor system in a vehicle documentation system.

FIG. 4 shows example logic implemented by an example sensor system, such as sensor system 300. For example, in an example, the system may identify predetermined settings for the sensor system 300 (401). The predetermined settings may be based on user-defined inputs such as size of a vehicle in the booth. For example, light settings may be based on a size of the vehicle being entered by an operator of the booth controller 130. In one implementation, the operator selects a size from a user interface, such as a compact size, sedan size, full-size size or any other indication of size of the vehicle. In this regard, the size of the vehicle may be designated automatically, such as via one or more sensors in the vehicle documentation booth 120 or via input from an operator. The designated size of the vehicle may be stored in a memory for access thereafter, such as for cropping of the image, discussed further below. Thus, the system may preprogram the lights per shot based on size of the vehicle and orientation of the camera being used to capture the image in an enclosed and controlled environment within the booth 120. The predetermined settings may also include settings for other sensor systems equipped in the booth, such as a camera. The predetermined settings identified may be based on a controlled environment within the booth 120, such as a controlled, and hence known, ambient light intensity, sound level, and other conditions within the booth 120 that may affect the sensor systems in the booth 120.

Alternatively, or in addition, in an example, the sensor system 300 may receive a command from the booth controller 130 to actively monitor conditions in the booth 120 (402). The command may be to measure the light intensity at a particular orientation of the vehicle in the vehicle documentation booth 120. The light intensity may be metered, or measured by the camera sensor systems or by separate light sensor systems. The camera sensor systems may adjust shutter speeds based on measured light intensity. The particular orientation to measure light conditions may depend on the location of the sensor system 300. For instance, in case the sensor system is the front sensor system 140F, the connected light sensor 310 may be used to measure the intensity of light that may affect an image captured by the camera 312 connected to the sensor system 300. In response to the command, the light intensity information may be measured and communicated to the booth controller 130 (404, 406). Lighting the entire vehicle documentation booth 120 indiscriminately with static lighting is not conducive to good photography and other sensor measurements. Extra light causes glare on the vehicle and backlighting conditions. Thereby, the vehicle may not be seen as the subject of the image by being the brightest lighted subject in the image. This issue may be addressed by individual control of each light in the booth 120.

The booth controller 130 may in response transmit a second command to the sensor system 300 (408). The second command may be to capture an image of the vehicle. However, based on the measured, and/or known light intensity, the booth controller 130 may command the sensor system 300 to update the light settings to a set of light setting values provided as part of the second command. The new light settings may be provided to adjust the light intensity at the particular orientation of the vehicle and the camera 312 so as to minimize image artifacts such as reflection, bright spots, and any other such image artifacts. In case new light settings are detected (412) in the received second command, the sensor system 300 may in turn command the light controller to adjust intensity of one or more lights 160 located within the vehicle documentation booth 120 (416). The update light settings may be confirmed (418). For example, in case the booth 120 is equipped with a light sensor system, the light intensity may be measured to determine if the lights have been adjusted as per the specified settings.

Upon confirmation of the light settings, the camera sensors may be instructed or requested via the booth controller 130 to capture an image of the vehicle within the booth 120. In an example, the booth controller may send a web service request to the camera sensor system, which may be a webserver, to receive an image. In response, the camera sensor system may capture an image of the vehicle (420). The camera sensor system may be sent a set of predetermined settings such as digital zoom setting, shutter speed setting, or any other setting which may be one of the predetermined settings. The camera sensor system may provide a low resolution version of the captured image to the booth controller 130 (428). Further, the booth controller 130 may send an instruction to the camera sensor system to store the captured image (424). The low-resolution image may be reviewed at the booth controller 130 to determine whether the image should be stored. The image may be reviewed manually such as by an operator of the booth controller 130. Alternatively, or in addition, the image may be reviewed automatically for settings such as brightness, contrast, or any other image settings such as by using histogram analysis, or other image processing techniques. In response to the command from the booth controller 130, a high resolution image may be stored in the NAS 108 (426).

Figure 5:
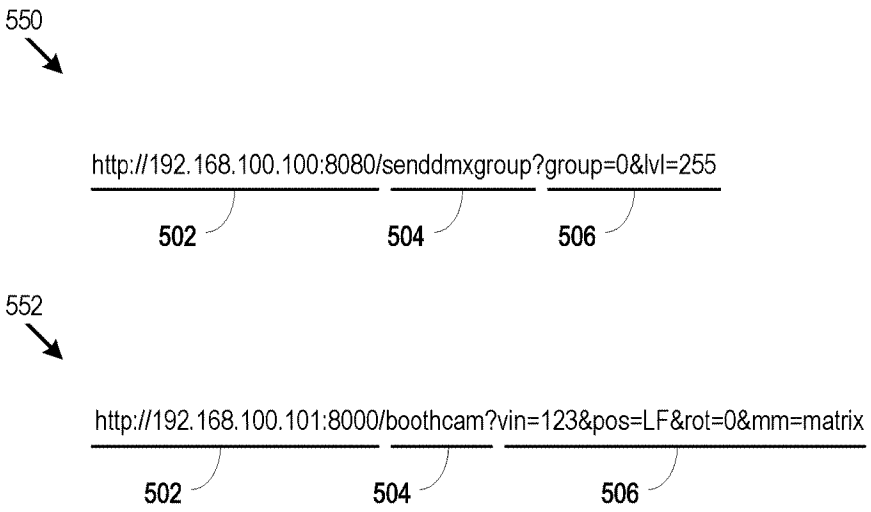
FIG. 5 shows example commands transmitted in a vehicle documentation system.

FIG. 5 shows example commands transmitted in an example vehicle documentation system. As will be evident by description throughout the document, the booth controller 130 may be a mobile device in communication with the components of the vehicle documentation system via a wireless medium. The booth controller 130 effectively communicates control information to sensor systems and in response receives the resulting measurements. For example, in case of the camera sensor systems, the booth controller 130 may execute an HTML document which in turn may request an image from a camera sensor system prompting the camera sensor system to acquire an image. The acquired image may be stored at a resolution the image is captured in and a lower resolution thumbnail image may be transmitted to the booth controller 130. Therefore, lower bandwidth may be required, permitting use of the wireless communication.

The command may be generated by the controller device 130, such as command 550. A command may include a unique identifier 502 of the destination device, such as a uniform resource locator (URL), or an Internet Protocol (IP) address and a port address, so that the command is routed to the intended device. For example, the command 550 indicates the IP address and port of the light controller 150 (see FIG. 1) while the command 552 is intended for the sensor system 140L1 (see FIG. 1). The command may further include a function 504 to be executed by the destination device. The function 504 may be part of an Application Programming Interface (API) provided by the destination device. Alternatively, the function 504 may be a custom function programmed for execution by the destination device. Example commands may further include a set of parameters 506 to be used during the execution of the function 504. The parameters 506 may be used for various purposes. For example, the parameters may indicate new setting values. Alternatively, or in addition, the parameters may provide information, such as filenames, date, time or any other information to be used by the destination device when storing results of the operation. The parameters 506 may further indicate information to annotate the results of the operation. Further yet, the parameters 506 may identify devices to which the command is to be relayed to.

The commands 550 and 552 are explained in detail further. The command 550 is a command intended for the light controller 150 as indicated by the IP address 502 (see FIG. 1). The function 504 of the command 550 indicates a function to set a light intensity values of lights in a predetermined group, group #0. Such commands facilitate fine turning of the indicated light for each shot providing better images and reduced glare from unneeded, extra light. The light intensity may be adjusted by configuring individual lights or a predetermined group of lights. The group of lights may be defined and adjusted for an image to be captured by a particular sensor system. For example, when capturing an image using the camera 312 of the sensor system 140F which is facing the front of the vehicle, the lights 160*a* facing that direction may be set to lower intensity and the lights in another direction, such as the lights 160*b* and 160*d* facing the vehicle from the left and right sides respectively may be set at a high intensity and the lights 160*c* facing the rear may be set at a medium intensity. The light intensities may be decided based on the measurement from the light sensor which may indicate ambient light in the vehicle documentation boot 120. Further, lights within each of those groups may be set to different intensities, so as to have a particular light intensity from the group as a whole. It will be understood that other configurations of light groups and intensities of the lights may be possible. In the example command 550, the group 0 as a whole is set to an intensity level 255.

The example command 552 is a command intended for the sensor system 140L1 as indicated by the IP address 502. (see FIG. 1). The function 504 of the command 552 indicates an adjustment being made to a camera in the booth. The parameters 506 in this case provide the camera to be adjusted (pos=LF), positioning and orientation of the camera (rot=0), and the light settings to use for this camera (mm=matrix). While two exemplary commands are illustrated, it will be understood that various other commands are possible. Table 1 below provides additional example parameters that may be provided.

TABLE 1

Meter Mode to change by camera location for lights.

| | | |
|---|---|---|
| 'spot', | //img0 | All Lights Off |
| 'spot', | //img1 | Front Lights On |
| 'spot', | //img2 | Left Lights On |
| 'matrix', | //img3 | Left Front Camera |
| 'matrix', | //img4 | Left Front Wheel Camera |
| 'spot', | //img5 | Rear Lights On |
| 'spot', | //img6 | Front Lights Off |
| 'matrix', | //img7 | Left Rear Wheel Camera |
| 'matrix', | //img8 | Left Rear Camera |
| 'spot', | //img9 | Left Lights Off |
| 'spot', | //img10 | Rear Half Lights On |
| 'spot', | //img11 | Rear Camera |
| 'spot', | //img12 | Rear Half Lights Off |
| 'spot', | //img13 | Rear Lights On |
| 'spot', | //img14 | Right Lights On |
| 'matrix', | //img15 | Right Rear Camera |
| 'matrix', | //img16 | Right Rear Wheel Camera |
| 'spot', | //img17 | Front Lights On |

TABLE 1-continued

| Meter Mode to change by camera location for lights. | | |
|---|---|---|
| 'spot', | //img18 Rear | Lights Off |
| 'matrix', | //img19 | Right Front Wheel Camera |
| 'matrix', | //img20 | Right Front Camera |
| 'spot', | //img21 | Left Lights Off |
| 'spot', | //img22 | Front Half Lights On |
| 'matrix', | //img23 | Front Camera |
| 'spot', | //img24 | All Lights On |
| 'spot']; | //img25 | Top Camera |

Table 2 below provides example settings of groups of lights corresponding to particular image orientations.

TABLE 2

| var camHosts = [ | | |
|---|---|---|
| 'DMX', | //img0 | All Lights Off |
| 'DMX', | //img1 | Front Lights On |
| 'DMX', | //img2 | Left Lights On |
| '192.168.100.101:8000', | //img3 | Left Front Camera |
| '192.168.100.102:8000', | //img4 | Left Front Wheel Camera |
| 'DMX', | //img5 | Rear Lights On |
| 'DMX', | //img6 | Front Lights Off |
| '192.168.100.103:8000', | //img7 | Left Rear Wheel Camera |
| '192.168.100.104:8000', | //img8 | Left Rear Camera |
| 'DMX', | //img9 | Left Lights Off |
| 'DMX', | //img10 | Rear Half Lights On |
| '192.168.100.105:8000', | //img11 | Rear Camera |
| 'DMX', | //img12 | Rear Half Lights Off |
| 'DMX', | //img13 | Rear Lights On |
| 'DMX', | //img14 | Right Lights On |
| '192.168.100.106:8000', | //img15 | Right Rear Camera |
| '192.168.100.107:8000', | //img16 | Right Rear Wheel Camera |
| 'DMX', | //img17 | Front Lights On |
| 'DMX', | //img18 | Rear Lights Off |
| '192.168.100.108:8000', | //img19 | Right Front Wheel Camera |
| '192.168.100.109:8000', | //img20 | Right Front Camera |
| 'DMX', | //img21 | Right Lights Off |
| 'DMX', | //img22 | Front Half Lights On |
| '192.168.100.110:8000', | //img23 | Front Camera |
| 'DMX', | //img24 | All Lights On |
| '192.168.100.111:8000']; | //img25 | Top Camera |

Figure 6:
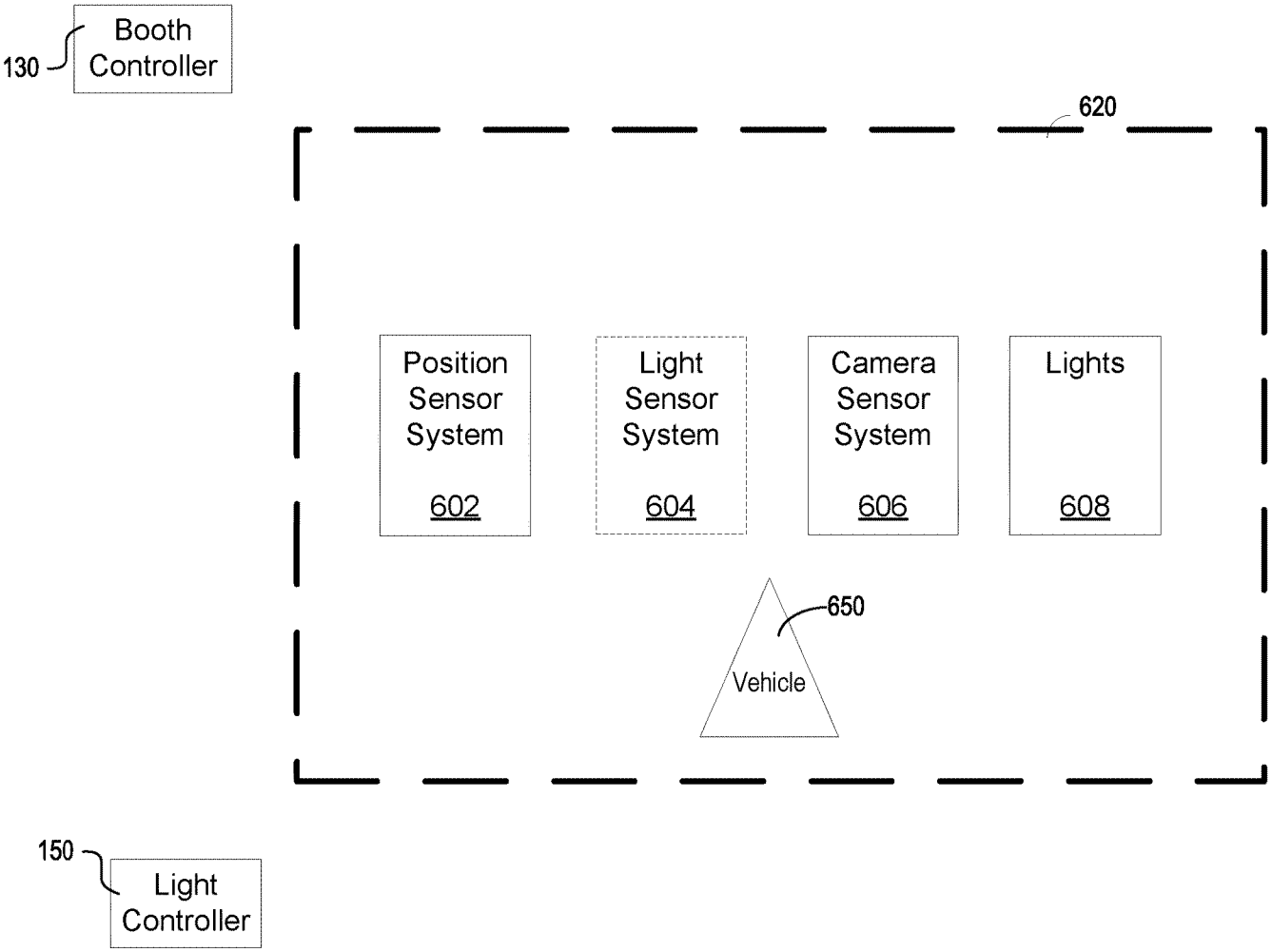
FIG. 6 shows an example vehicle documentation booth.

In another example, the controller device 130 may command various different sensor systems to generate documentation for a vehicle in the vehicle documentation booth 120. FIG. 6 shows an example vehicle documentation booth 620. The vehicle documentation booth 620 includes various sensor systems such as position sensor system 602, light sensor system 604, camera sensor system 606. The vehicle documentation booth 620 may include additional sensor systems, such as microphones, vibration sensors, temperature sensors, ultrasonic sensors and other measuring devices. The vehicle documentation booth 620 further may include lights 608, controllable via the light controller 150. The booth controller 130 may manage operations of the various sensor systems and lights to generate documentation of a vehicle 650 positioned within the vehicle documentation booth 620.

The various sensor systems may include circuitry similar to that described with respect to the sensor system 300. The sensor systems may be webservers that receive a command or request from the booth controller 130. In response, the sensor systems may capture information via the sensors equipped on the sensor systems and transmit the captured information to the booth controller 130. The different sensor systems may be equipped with different sensors to capture information. Alternatively, the sensor systems may all be equipped with a set of sensors out of which a subset is utilized. For example, the position sensor system 602 may be equipped or may use position sensors. The position sensors may use infrared, ultrasonic, weight, temperature or other such physical characteristics to determine position of the vehicle 650. The light sensor system 604 may be equipped with or may use light sensors that measure intensity of light within the vehicle documentation booth 620. The light intensity measured may be the ambient light in the vehicle documentation booth 620.

The camera sensor system 606 may be equipped with a still image or a video capture camera. The camera may be adjusted by the booth controller 130 and/or the camera sensor system 606. For example, the camera may be adjusted to zoom-in or zoom-out. The zooming may be a digital zoom (sometimes referred to as solid-state zoom), or an optical zoom, or a combination of both.

For example, the region of an image sensor of the camera sensor system 606 used to capture the vehicle may be adjusted based on the size of the vehicle 650. For example, in case the vehicle 650 is a small vehicle, a smaller region of the image sensor may be utilized to capture the image of the vehicle 650, while a larger region of the image sensor may be used in case the vehicle 650 is a large vehicle. The size of the vehicle 650 may be specified by an operator of the booth controller 130, or may be determined based on information, such as that obtained from a vehicle information database, given inputs (e.g., a VIN), for example, that identify the make/model of the vehicle 650. For example, if the vehicle is identified as a sedan, the system may identify the vehicle as medium sized, while in case the vehicle is identified as a minivan or SUV, the vehicle may be considered large sized. The amount of the image sensor used to obtain the vehicle image may then vary according to the determined vehicle size, with larger vehicles using larger extents of the image sensor.

Additionally, or alternatively, the camera may be adjusted to pan in specific direction. A flash function on the camera may also be adjusted. Further, the camera may be adjusted to change lens exposure level, shutter speed, and any other such settings.

The booth controller 130 may also adjust the lights 608 by altering the intensity settings, such as to dim or brighten the lights. The light controller 150 may also be a webserver able to receive commands from the booth controller or the sensor systems. The commands to the light controller may indicate adjustment to be made to the lights 608, such as turning a light, or a group of lights on or off, or adjusting brightness of a light or a group of lights, or flashing the lights on and off.

The lights 608 may be divided into various groups. An individual light may be part of one or more groups. Each light may be assigned a unique identifier. Further, each group may also be assigned a unique identifier. The booth controller 130 or the sensor systems may provide settings to be applied to a light or a group of lights by indicating the corresponding identifier and the settings to be applied, such as in command 550 of FIG. 5. The groups of lights may be defined such that each group of lights is used when capturing information from a particular orientation.

The vehicle 650 may be an automobile, such as a car, sports utility vehicle (SUV), mini-van, truck, motorcycle, or any other automobile. The vehicle 650 may also be a boat, an airplane, or any other vehicle. The booth controller 130 may identify the vehicle based on an identifier of the vehicle, such as the VIN. The booth controller 130 may request information of the vehicle from a database. The database may be in the NAS 108, or on a server that is part of the network 102. The database may provide information such as vehicle make, model, year of manufacture, history of sales, odometer reading, interior conditioning, and any other details of the vehicle. The details may also provide whether the vehicle has air conditioning, leather seats, navigation, and/or other features of the vehicle.

Figure 7:
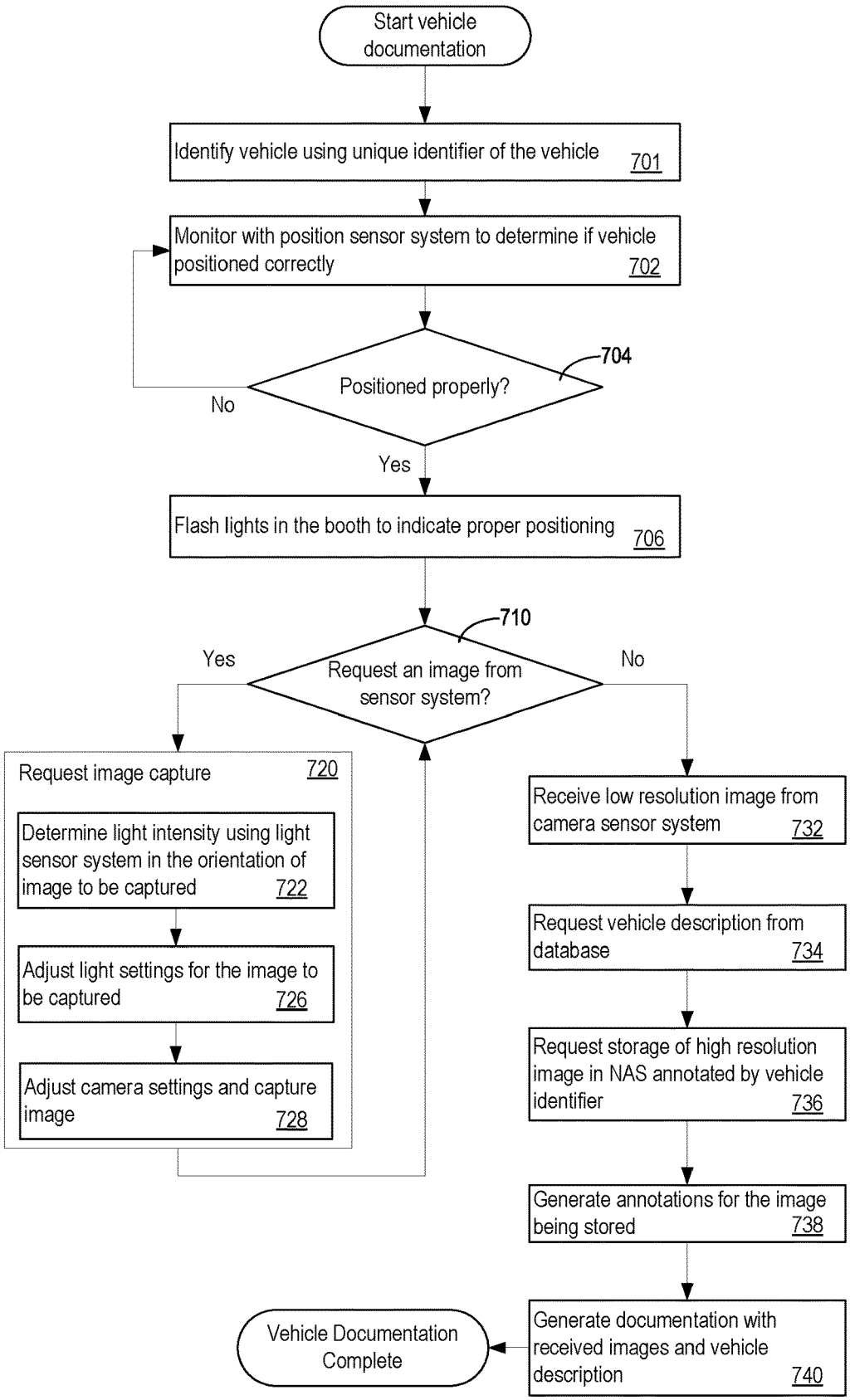
FIG. 7 shows an example vehicle documentation generation method.

FIG. 7 shows an example vehicle documentation generation method. The method may be performed by the booth controller 130. The booth controller 130 may identify the vehicle based on the vehicle identifier (701). The vehicle identifier may be manually entered by an operator. Alternatively, the vehicle identifier may be scanned using a scanner, such as a barcode scanner, or a camera. The scanner may be equipped on the booth controller 130. The vehicle identity may indicate a size of the vehicle. For example, the size may be provided as length, width, and height dimensions of the vehicle. Alternatively, the size may be provided as a size-category, such as a small, medium, large, extra-large. In another example, the size may be provided as a category of the vehicle itself, such as a compact, sedan, mid-size, full-size, SUV, cross-over, truck, or other such vehicle category.

Based on the identified size of the vehicle 650, the booth controller 130 may determine a position within the booth 620 at which the vehicle 650 should be placed to capture other information of the vehicle, such as images of the vehicle. Since, the camera sensor system 606 may be in a fixed position within the booth 120, and the vehicle 650 is movable, depending on where the vehicle 650 is positioned, it may or may not be aligned in the image. So an accurate method of feedback to an operator positioning the vehicle 650 may be provided to stop the car in the right position. The booth controller 130 may monitor the position of the vehicle 650 within the vehicle documentation booth 620 (702). The booth controller 130 may continuously receive position information of the vehicle from the position sensor system 602 for such monitoring. The position information may be received in response to the booth controller 130 requesting such information from the position sensor system 602. The booth controller 130 may compare the received position information with the determined position where the vehicle 650 is to be placed (704). The vehicle 650 may be moved until the vehicle 650 is placed in the determined position. Once the vehicle 650 is substantially in the determined position, the booth controller 130 may provide an indication of the position. For example, the booth controller 130 may send commands for the light controller 150 to flash some or all of the lights 608 within the booth 620 (706).

The booth controller 130 may then determine what information of the vehicle 650 is to be captured using the various sensor systems within the booth 620. For example, images of the vehicle 650 from various angles may be captured to further document the vehicle 650. Such information may be used to generate vehicle documentation that may be useful for sharing with potential bidders or customers who may be interested in purchasing the vehicle 650. If an image is required, a request to capture the image from the particular viewpoint may be sent to the camera sensor system 606 (710, 720). Capturing the image may involve various steps in itself (720). For example, initially, intensity or brightness of the ambient light in the booth 620 may be determined (722). The ambient light may be measured for capturing the image from a particular vantage point, or angle, or orientation of the vehicle 650 (722). For example, a front view of the vehicle 650 may be captured. The front view may be captured with or without the vehicle hood opened. Other angles and orientations may be possible such as a side view from the driver's side or from the passenger's side; rear view; top view; interior view; or any other view of the vehicle to illustrate features of the vehicle to the potential bidders or customers.

The booth controller 130 may determine optimal light intensity or brightness to capture a presentable image of the vehicle 650 from the particular vantage point. The actual light intensity may be measured using the light sensor system 604 (722). The actual light intensity may be compared with the calculated optimal light intensity and accordingly, settings for the lights 608 may be calculated. The calculated settings may be applied to the lights 608 so that the optimal light intensity is achieved in the booth 620 (726). The calculated settings may be applied using the light controller 150. The booth controller 130 or the camera sensor system 606 may be responsible for calculate the updated settings and request the light controller 150 to apply the updated settings. As described throughout the document, the light settings may involve updating individual lights or group of lights.

Further, the booth controller 130 may determine settings of the camera sensor system from the particular vantage point from which an image is to be captured based on the vehicle size, the light intensity, and other parameters (726). Once the light settings and camera settings are updated, the camera sensor system 606 may capture an image of the vehicle 650 from the specified vantage point (728). The booth controller 130 may send a request to the camera sensor system 606 to capture the image once the settings have been updated. Further, the booth controller 130 may send multiple requests to the camera sensor system 606 to capture multiple images from the particular vantage point. The multiple images may be captured using the different combinations of the light and/or camera settings. For example, multiple images from the particular vantage point with same light settings but different camera settings may be captured. For instance, an image from the camera sensor system 606 positioned close to the left front of the vehicle 650 may be used to capture an image of the entire vehicle 650 as well as an image that provides details of the left front tire of the vehicle 650. Alternatively, or in addition, the light settings may also be changed for the two images captured. Images other than those described as examples in this document may be captured.

The fixed camera sensors system 606 in the vehicle documentation booth 120 may capture exterior images of the vehicle 650. Interior shots of the vehicle 650 may be captured by using the booth controller 130, which is a mobile device. The booth controller 130 may be equipped with an onboard camera that may be controlled by an application interfaced with the vehicle documentation generation system. The interior images may be captured as part of the workflow of controlling the documentation booth 120 (728). The interior images may then be integrated into the set of images captured from the camera sensor system 606.

The image captured by the camera sensor system 606 may be stored at a resolution at which the image is captured, such as 2 Mega Pixel (MP), 5 MP, 13 MP, or any other resolution the camera may be set for. However, the image may be converted to a lower resolution image, such as a thumbnail image, or 640×480, or any other resolution. The lower resolution image may be forwarded to the booth controller 130. The booth controller 130 may receive and display the lower resolution image (732). An operator may view the displayed lower resolution image and determine whether the image needs to be retaken. For example, the image may be too noisy, or there may be a reflection, or the image may be distorted. If the image is retaken, the earlier image may be replaced by the retaken image. Alternatively, the retaken image may be stored in addition to the earlier image.

Information of the vehicle 650 may be requested from the database (734). The information may be requested using the unique identifier of the vehicle 650. The information received in response may be used to annotate the image when stored and/or when generating the documentation for the vehicle 650.

In case the image is acceptable, the booth controller 130 may request the camera sensor system 606 to store the image (736). For example, the booth controller 130 may display various user interface elements, such as an archival directive element. The operator may interact with the user interface elements to send requests to the sensor systems and/or light controller 150. For example, the archival directive element may send a request to the camera sensor system 606 to store the image at a high resolution, such as the resolution at which the image was taken. Alternatively, the booth controller 130 may send a command that indicates a resolution at which the image is to be stored. The resolution may be one of the parameters in the command sent, such as the commands 550 and 552. Alternatively, the resolution may be a predetermined resolution that has been communicated to the camera system 606 previously. Alternatively, or in addition, the command or request sent by the booth controller 130 may contain a destination to store the image. The destination may be the NAS 108. The destination may further specify details such as a folder within the NAS 108. Thus, the captured image may be stored in the specified destination without being first transferred to the booth controller 130.

Further yet, the command or request may include other parameters to indicate annotations for the image being stored, such as the unique identifier of the vehicle 650 to be included in the filename or as a tag at the time the image is stored (738). The camera sensor system 606 may include further annotations to the filename or as tags to the image. For example, the camera sensor system 606 may include orientation, such as 'left front' or 'left front tire', when storing the image. Other annotations may also be possible, such as the settings applied to the camera sensor system and the light settings used when capturing the image. Additionally, the information obtained from the database, indicating features and other information of the vehicle 650 may be used as annotations.

The captured images and the information received from the database may be put together to generate documentation of the vehicle 650. The documentation may be in form of a web-page, document, tabular display, worksheet, database table, or any other format. For example, a webpage, such as an Hyper Text Markup Language (HTML) page, may be generated with the images and the information rendered on the webpage. It is understood that HTML is just one possible example format and other formats such as Extensible Markup Language (XML), Portable Document Format (PDF), Open Document Format (ODF), or any other proprietary or non-proprietary formats may be used to generate the documentation. The generated documentation may be static or dynamic in nature. Static documentation is non-interactive, whereas dynamic documentation may be more interactive in nature. For example, the images displayed in the documentation may be thumbnail images, and when interacted with, such as by clicking, may display the corresponding higher resolution image. Alternatively, or in addition, the interaction may display vehicle details pertaining to the image that is being viewed in detail.

The generated documentation may be presented to the potential bidders and customers to review the vehicle information so as to determine whether to pursue a sale of the vehicle. The generated documentation may be integrated with a web-portal of a seller or auctioneer of the vehicle. Thus, upon entry of the vehicle into the vehicle documentation booth, with a few interactions with the booth controller, the seller or auctioneer, may be able to capture images of the vehicle from various angles and vantage points, link the images to the vehicle information in a database and generate documentation, such as a webpage, that may be presented to a potential purchaser as marketing material with the vehicle images and information. The vehicle documentation system described may thus enable or enhance efficiency of operation of a seller or auctioneer, such as a vehicle dealer or auctioneer.

As discussed above, various types of vehicles may enter the vehicle documentation booth. For example, cars with different rooflines, different wheelbases, and the like may enter the vehicle documentation booth to obtain images of the cars. The varying dimensions of the cars complicates obtaining images of the cars in a consistent manner. Further, the vehicles may be driven into the vehicle documentation booth. Because of this, the point at which the vehicle stops within the vehicle documentation booth may likewise vary. Again, because of this variance, obtaining images of the vehicles in a consistent manner may be difficult.

In one implementation, the size of the vehicles may dictate how the image is taken and/or what portion of the image is used. For example, one or more sensors (such as using sensor systems 140) may be used to determine the size of the vehicle. For example, the sensor systems 140 may determine that the vehicle in the vehicle documentation booth is designated as "small". In turn, one or more cameras may capture images of various parts of the vehicle depending on the determined size. As one example, for a vehicle designated as "small", a first camera may take an image of the right side of the vehicle. In the case of the first camera being fixed in position, the image obtained by the camera may be manipulated electronically (e.g., cropped) based on the designated size in order to obtain the desired portion of the vehicle (e.g., the right side of the vehicle). This manipulation (e.g., cropping) may be performed either at the camera or at the booth controller 130.

For example, the booth controller 130 may command the camera to send only a subpart of the image obtained by the camera. In practice, the camera may take an image that is 5 Mega Pixel (MP). However, due to the designated size of the vehicle (e.g., "small"), the booth controller 130 may command the camera to send only a subpart of the 5 MP image. For example, the booth controller 130 may send one or more criteria to indicate to the camera the subpart of the image to send to the booth controller. Specifically, the booth controller 130 may send the starting point in the image, and an indication in the X and Y directions how much to send. By way of a first example, responsive to the designation of the vehicle as "small", the booth controller 130 may access a look-up table correlating the "small" designation with the first camera (tasked to obtain the right side of the vehicle) to determine the predetermined starting point in the image (0,0), and the indication in the X and Y directions (0.6 in the X direction (indicating 60% of the image in the X direction), and 0.5 in the Y direction (indicating ½ of the image in the Y direction)). Thereafter, the booth controller 130 may send a command to the first camera with the starting point in the image of (0,0), X (0.6) and Y (0.5). By way of a second example, responsive to the designation of the vehicle as "medium", the booth controller 130 may access a look-up table correlating the "medium" designation with the first camera (tasked to obtain the right side of the vehicle) to determine the predetermined starting point in the image (0,0), and the indication in the X and Y directions (0.7 in the X direction (indicating 70% of the image in the X direction), and 0.6 in the Y direction (indicating 60% of the image in the Y direction)). The booth controller 130 may then send a command to the first camera with the starting point in the image of (0,0), X (0.7) and Y (0.6). Thus, the booth controller 130 may command the camera to send a designated portion of the image responsive to the designation of the booth controller 130 as to the size of the vehicle. Responsive to receipt of the command, the camera may send the designated portion of the image. In one implementation, the camera may send the designated portion of the image to the booth controller 130, after scaling the designated portion of the image to a predetermined size. Alternatively, the camera may send the designated portion of the image to the booth controller 130, with the booth controller thereafter scaling the designated portion of the image to the predetermined size.

As another example, the booth controller 130 may receive the entire image taken by the camera and thereafter perform the manipulation of the image itself. Thus, regardless of which device performs the manipulation (e.g., whether the camera or the booth controller 130 performs the cropping), the image may be manipulated in one or more dimensions based on the size of the vehicle. Different definitions of dimensions are contemplated. As one example, if working in the Cartesian coordinate system, the Z-axis may be defined as move closer/further away from the vehicle, the Y-axis may be defined as moving upward or downward, and the X-axis may be defined as right or left. In such as Cartesian coordinate system, the values for each of the X-axis, Y-axis and Z-axis may be defined by the designated size of the vehicle. As another example, the size of the vehicle may define the starting point, X-direction, and Y-direction, as discussed above. Likewise, in such a definition, the values for each of the starting point, X-direction, and Y-direction may be defined by the designated size of the vehicle.

In an alternate implementation, image analysis in combination with a designated size of the vehicle may dictate how the image is taken and/or what portion of the image is used. If working in the Cartesian coordinate system, one or two of values in the X-axis, Y-axis, or Z-axis may be determined by the designated size of the vehicle and a remainder of values for the X-axis, Y-axis, or Z-axis may be determined by computer vision analysis. If working in the starting point, X-direction, and Y-direction, one or two of the starting point, X-direction, and Y-direction may be determined by the designated size of the vehicle and a remainder of the starting point, X-direction, and Y-direction may be determined by computer vision analysis. In this regard, the parameters are determined is based on both the size of the vehicle and the computer vision analysis is based on both the size of the vehicle and the computer vision analysis. This is unlike the three criteria (starting point, X-direction, and Y-direction) being determined by the designated size of the vehicle, or unlike the three criteria being determined partly based on the designated size of the vehicle and partly independent of the vehicle (e.g., the entire field of view of the camera is used), as discussed above.

For example, wheelbases of vehicles may vary considerably, as discussed above. In that regard, the rear wheels may pose a problem in the image (either in regards to a side view of the entire vehicle or a close-up of the rear wheel). In this implementation, because of the variance in the wheelbases, the X-direction criterion (with the X-axis being defined along the wheelbase of the vehicle) may be determined based on computer vision analysis while the starting point and Y-direction criteria may be determined by the designated size of the vehicle. Alternatively, the Y-direction and Z-direction may be determined by the designated size of the vehicle while the X-direction may be determined by computer vision. In this way, a combination of predetermined analysis (based on the designated size) and dynamic analysis (based on computer vision) may be used in order to manipulate the obtained image.

In a second alternate implementation, all of the criteria (e.g., the starting point, the X-direction criterion, and the Y-direction criterion; or the X-direction, Y-direction, and Z-direction) are determined by computer vision analysis.

As discussed in more detail below, computer vision analysis may find different features of the vehicle, and manipulate the obtained image accordingly. For example, the computer vision analysis may identify single shapes within the image, such as a circle, a square, a triangle or the like. In a specific example, a single circle, which may correspond to the hubcap, the inner part of the tire, or the outer part of the tire, may be identified. After which, the image may be manipulated based on the identified single shape within the image (e.g., center the image on the identified circle). In particular, the obtained image may be cropped in order to center the image on the identified circle (e.g., modify the obtained image by discarding pixels within an obtained image so that the modified obtained image is centered on the identified circle). As another example, the computer vision analysis may identify multiple shapes that may form a pattern. In a specific example, multiple concentric circles, such as corresponding to the inner part of the tire and the outer part of the tire, may be identified. Thereafter, the obtained image may be cropped in order to center the image on the identified pattern (e.g., modify the obtained image by discarding pixels within an obtained image so that the modified obtained image is centered on the identified pattern).

As discussed above, booth controller 130 and/or sensor 300 may comprise analysis logic 204 or 306, respectively, for analyzing the data obtained from sensor 300. The analysis logic may comprise analytical circuitry and modification circuitry, such as software, firmware, programmable logic, or the like to manifest the analytical functions described herein. In one implementation, the analysis logic may comprise any one, some, or all of the following: identification of one or more objects, shapes or patterns within the data obtained by a sensor; and modification of the data obtained by the sensor based on the identification of the one or more objects, shapes or patterns within the data (e.g., removing pixels from the data obtained by the sensor in order to center the image on the identified object, the identified shape, or the identified pattern).

Alternatively, or in addition, in the event that it is determined that the object, shape or pattern was not found in the data, the control of the sensor is modified in order to obtain different data. For example, the camera may be configured to obtain a first image with a first set of parameters (such as a first field of view). In one implementation, the first set of parameters is selected independent of the designated size of the vehicle. For example, the first set of parameters may set the field of view to its widest setting. After which, the first image may be analyzed to determine whether the object, shape or pattern was found in the first image. If the object, shape or pattern was not found in the first image, the camera may be configured to obtain a second image with a second set of parameters (such as a second field of view different from the first field of view), whereby the second set of parameters is at least partly different from the first set of parameters (e.g., changing the field of view of the sensor and obtaining a different image). In one implementation, at least some of the second set of parameters is selected dependent on the designated size of the vehicle (and in a more specific implementation, all of the second set of parameters are selected dependent on the designated size of the vehicle). For example, the first set of parameters may set the field of view to its widest setting, whereas the second set of parameters may set the field of view dependent on the designated size of the vehicle (e.g., smaller field of view for a vehicle designated as "small" versus a wider field of view for a vehicle designated as "large").

In one implementation, the analysis is performed at the booth controller 130, whereby the sensor 300 sends the sensor data to the booth controller 130 for analysis and potential modification by analysis logic 204. In another implementation, the analysis is performed by the sensor 300, whereby the booth controller 130 may instruct the sensor 300 to perform the analysis, with the sensor obtaining the sensor data and, responsive to the instruction to the booth controller 130, perform the analysis and modify the sensor data using analysis logic 306. In still another implementation, the sensor 300 sends the sensor data to the booth controller 130 for analysis, and based on the analysis, the booth controller 130 commands the sensor 300 to perform the modification.

Figure 8:
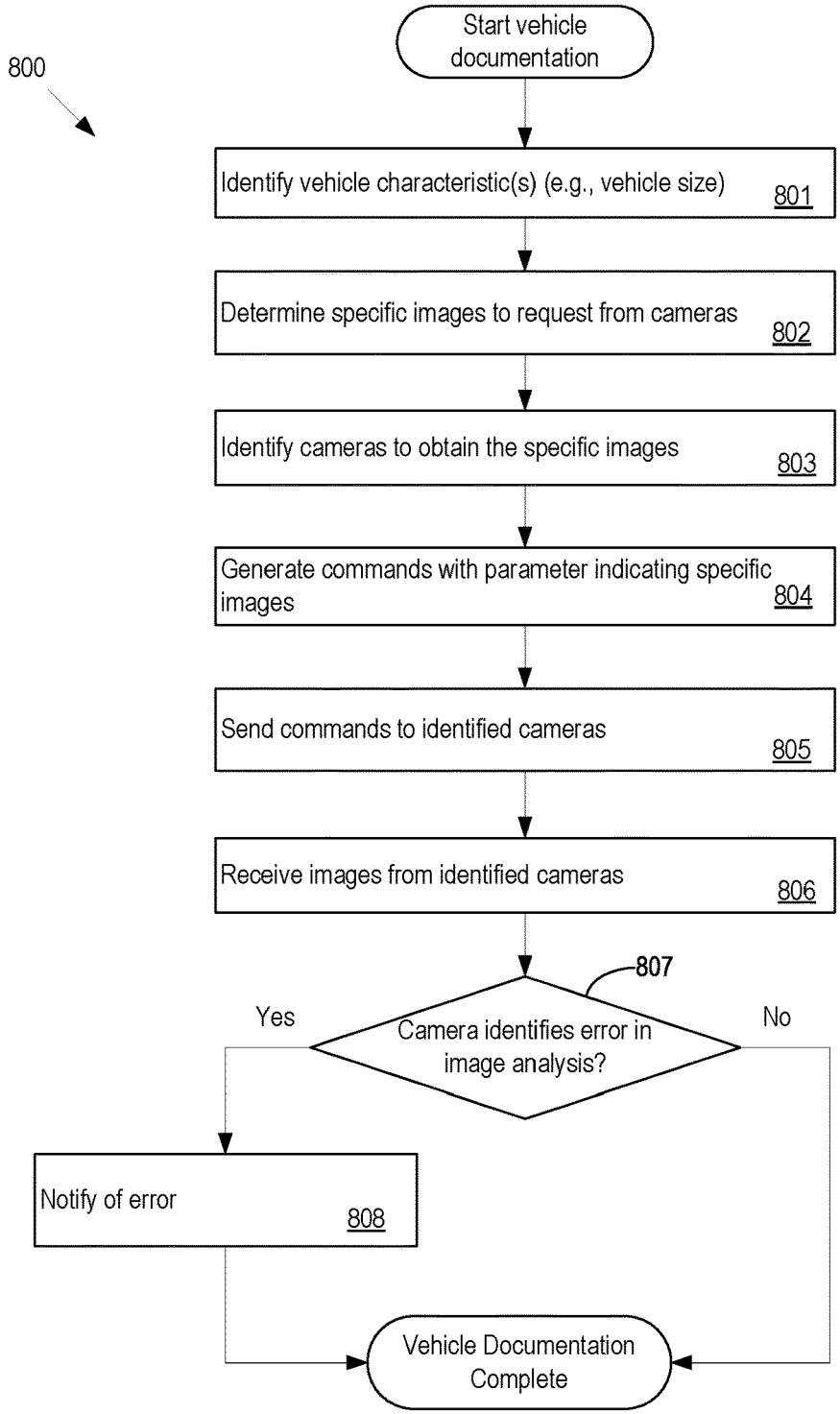
FIG. 8 shows an example vehicle documentation generation method from the perspective of the server commanding the taking of images.

FIG. 8 shows an example vehicle documentation generation method 800 from the perspective of the server commanding the taking of images. As discussed above, one example of a local server comprises booth controller 130. At 801, one or more vehicle characteristics are identified. One example vehicle characteristic comprises vehicle size. As discussed above, vehicle size may be determined in one of several ways. At 802, the server determines one or more images to obtain from the vehicle. For example, in one context, the server may determine to obtain a predetermined set of images of the vehicle. The predetermined set may include pictures of a specific wheel (e.g., the front left wheel), a specific vehicle part (e.g., the vehicle logo on the front grille or the front bumper) or the like. At 803, the server may determine the cameras to control in order to obtain the specific images. For example, responsive to determining that an image of the front left wheel is desired, the server may determine which camera is position to obtain the image of the front left wheel. As discussed above, sensor systems 140L1-L4 may be used to obtain images of the left of the vehicle.

At 804, the server may generate a command to send to the identified sensor system. The command may include an indication to the sensor system to obtain the specific image. The indication in the command may take one of several forms. For example, the indication may comprise a field in the command. In particular, the command may include a field of a file name (e.g., the sensor system generates the sensor data and packages the data in a file name according to the field for the file name. The server may include the indication of the specific image in the file name (e.g., "WHEEL" in the file name). In this way, the sensor system may determine, based on a review of the field for the file name, the specific image to obtain. Other ways for the server to indicate the specific image to the sensor system are contemplated. At 805, the command is sent to the identified cameras.

At 806, responsive to sending the command at 805, the images are received from the identified cameras. At 807, the server determines whether the camera identified an error in the image analysis. As discussed in more detail below, the camera, in the process of performing image analysis, may determine that there is an error. For example, the camera, using the image analysis, may fail to identify the desired object within the sensor data (e.g., fail to identify a wheel within the image data obtained). In response thereto, the camera may include an indication of this error in the image sent to the server. In response to determining that there is an indication of an error, at 808, the server may notify of the error.

Figure 9:
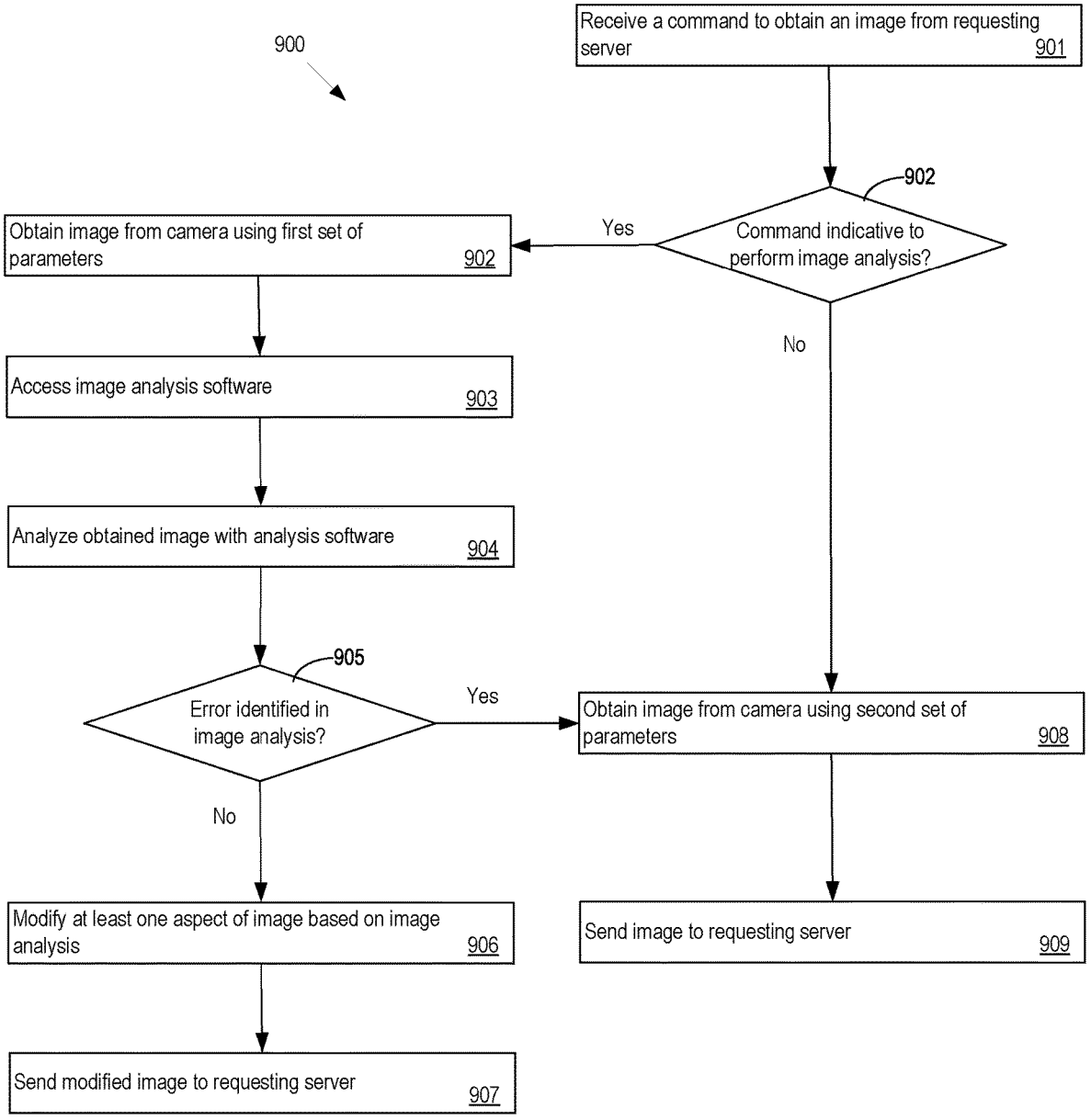
FIG. 9 shows a first example vehicle documentation generation method from the perspective of the sensor system obtaining the images.

FIG. 9 shows a first example vehicle documentation generation method 900 from the perspective of the sensor system obtaining the images. At 901, the sensor system receives a command to obtain an image from a requesting server. At 902, the sensor system determines whether the command indicates an instruction to perform image analysis. As discussed above, the command may include one or more fields, which may indicate image analysis is requested. For example, the file name may indicate a particular vehicle part, such as WHEEL, which indicates to the sensor system that the image analysis is to identify the wheel (such as the shape of a circle, or the pattern of multiple concentric circles) in the obtained image.

If the command indicates image analysis, at 902, the sensor system obtains the image of the vehicle using a first set of parameters for the camera. As discussed above, the camera may be configured in one or more parameters, such as field of view. In that regard, the sensor system may configure the camera with the parameters, such as the field of view, in order to obtain an image for subsequent analysis. For example, the first set of parameters may comprise an entire field of view of the camera. At 903, the sensor system accesses the image analysis software, which may be resident in analysis logic 306. At 904, the sensor system analyzes the obtained image using the image analysis software. As discussed above, the image analysis software may perform one or more functions, such as identifying an object within the image (e.g., a wheel within the image).

At 905, the sensor system determines whether there is an error in the image analysis. For example, in the event that the image analysis software attempts and fails to identify the wheel within the obtained image, the image analysis software may return an error. If an error is returned, at 908, the sensor system obtains an image from the camera using a second set of parameters, with at least one of the parameters in the second set being different from the first set. For example, the field of view in the second set of parameters may be different than in the first set of parameters. In particular, the field of view for the first set of parameters may be the entire field of view for the camera (which allows for cropping of the obtained image thereafter) whereas the field of view for the second set of parameters is more narrowly tailored. For example, the field of view for the second set of parameters is smaller than the entire field of view for the camera, and is based on the designated size of the vehicle, such as discussed above. At 909, the image obtained using the second set of parameters is sent to the server.

If there is no error determination at 905, at 906, at least one aspect of the image is modified based on the image analysis. In one implementation, the sensor system performs the modification of the image based on the image analysis. For example, responsive to identifying a wheel within the image, the sensor system may modify the image based on the wheel identified within the image. The modification of the image may take one of several forms. In one form, the image, subject to the image analysis, may be modified (such as cropped). In another form, the camera, which is a part of the sensor system, may be commanded to take another image, different from the image subject to the image analysis, with new parameters selected based on the image analysis. By way of example, the camera may be initially commanded to obtain a first image with the following parameters: starting point (0, 0), X-direction 1.0 (indicative of an entire field of view in the X-direction); Y-direction 0.5 (indicative of 50% of the field of view in the Y-direction and selected based on the size of the vehicle). After analysis of the first image, the camera may thereafter be commanded to obtain a second image with the following parameters: starting point (0, 0), X-direction 0.6 (indicative of 60% of the field of view in the X-direction and selected based on the image analysis); Y-direction 0.5 (indicative of 50% of the field of view in the Y-direction and selected based on the size of the vehicle). Thus, in one implementation, the sensor system may crop the image so that the wheel is placed within the center of the image (e.g., in the horizontal and/or vertical center of the image). At 907, the sensor system sends the modified image to the server.

Figure 10:
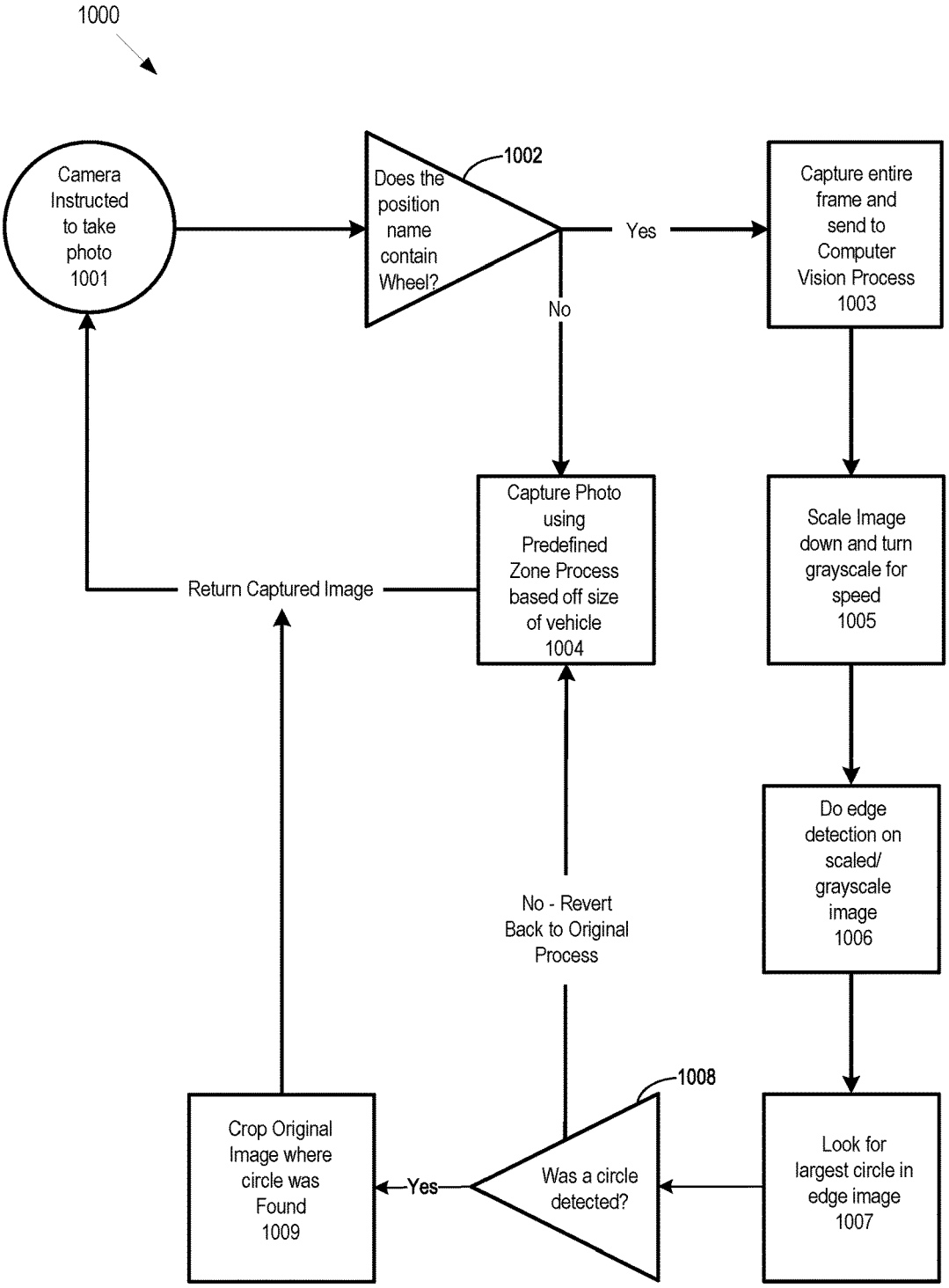
FIG. 10 shows a second example vehicle documentation generation method from the perspective of the sensor system obtaining the images.

FIG. 10 shows a second example vehicle documentation generation method 1000 from the perspective of the sensor system obtaining the images. At 1001, the camera of the sensor system is instructed to take a photo. At 1002, the sensor system determines whether the position name contains the word "Wheel". As discussed above, there are several ways in which the sensor system may be directed to perform image analysis, such as image analysis identifying a wheel within the image. One way is by including the indication in the position name. If the position name contains "Wheel", at 1003, the camera captures the entire frame and sends the captured image to the computer vision process.

At 1005, the captured image is scaled down and turned to grayscale. This scaling/grayscaling may be done to increase the speed of the computer vision processing. In one implementation, changing the image to grayscale comprises changing the value of each pixel such that a respective pixel carries only intensity information. Images of this sort, which may also be known as black-and-white, are composed exclusively of shades of gray, varying from black at the weakest intensity to white at the strongest.

At 1006, edge detection on the scaled/grayscale image is performed. Edge detection may identify one or more points in the digital image at which the image brightness has a discontinuity or a change. The points at which the image brightness changes sharply may be organized into a set of curved line segments that is termed edges, resulting in edge detection.

At 1007, the largest circle is identified in the edge image. As discussed above, the computer vision process may use one of several methodologies, such as OpenCV for object identification, such as for circle identification.

At 1008, it is determined if a circle was detected. If so, it is presumed that the detected circle correlates to the wheel of the vehicle. Thus, at 1009, the original image is cropped based on where the circle was found. In one implementation, the original image captured by the camera is modified (e.g., scaled and grayscaled) and used for image analysis, and is also used for modification (e.g., cropping) based on the image analysis. The cropped image may thus be centered on the wheel of the vehicle. In an alternate implementation, the camera is instructed to obtain a second image with modified parameters in order for the second image to center on the wheel of the vehicle.

If the circle was not detected, at 1004, the image of part or all of the vehicle is captured using a predefined zone process based on the size of the vehicle. As discussed above, the size of the vehicle may be determined in one of several ways. The determined size may thus be used in selecting a predefined zone process. Further, an indication of the size of the vehicle may be transmitted to the sensor system in the command to obtain the picture. Thus, similar to indicating to the sensor system to obtain a picture of the "wheel", the command may include an indication of the size of the vehicle. In this way, in the event that there is an error in identifying the object in the image (e.g., a failure to identify the wheel in the obtained image), the camera in the sensor system may be controlled so that a different image may be obtained. For example, the camera may be controlled with a different field of view, such as a more narrow field of view, than that obtained and analyzed previously. In particular, the initial field of view in the X-direction may be 1.0 (the entire field of view). After computer vision analysis, the field of view may be narrowed, such as to 0.6 (which is a subset of the entire field of view).

For example, a specific camera may receive a command indicating the specific camera to obtain a picture of the "wheel" and indicating that the size of the vehicle is small. In response to the specific camera being unable to identify the wheel within the scaled-down/grayscaled image, the specific camera may obtain the picture of the wheel using a predefined field of view for a small vehicle.

In this way, the vehicle documentation system may perform image analysis locally (either at the local server level or at the sensor system level), thereby avoiding performing the image analysis at a remote server. Typically, vehicles will drive into and drive out of the vehicle documentation system. The vehicles may therefore pass through the vehicle documentation system in an assembly-type method, going through one after the other. Performing the image analysis locally aids in timely obtaining the images in this assembly-type method. In particular, the local image analysis may result in a quicker determination of an error. As discussed above, responsive to the error determination (e.g., being unable to locate the wheel within the captured image), the vehicle documentation system may obtain a second image. In contrast, performing remote analysis remotely may take longer, so that the error may be determined only after the vehicle has exited the vehicle documentation system. In the event that an error has occurred, the vehicle will need to re-enter the vehicle documentation system, making the taking of the second image much harder to perform.

Figure 11:
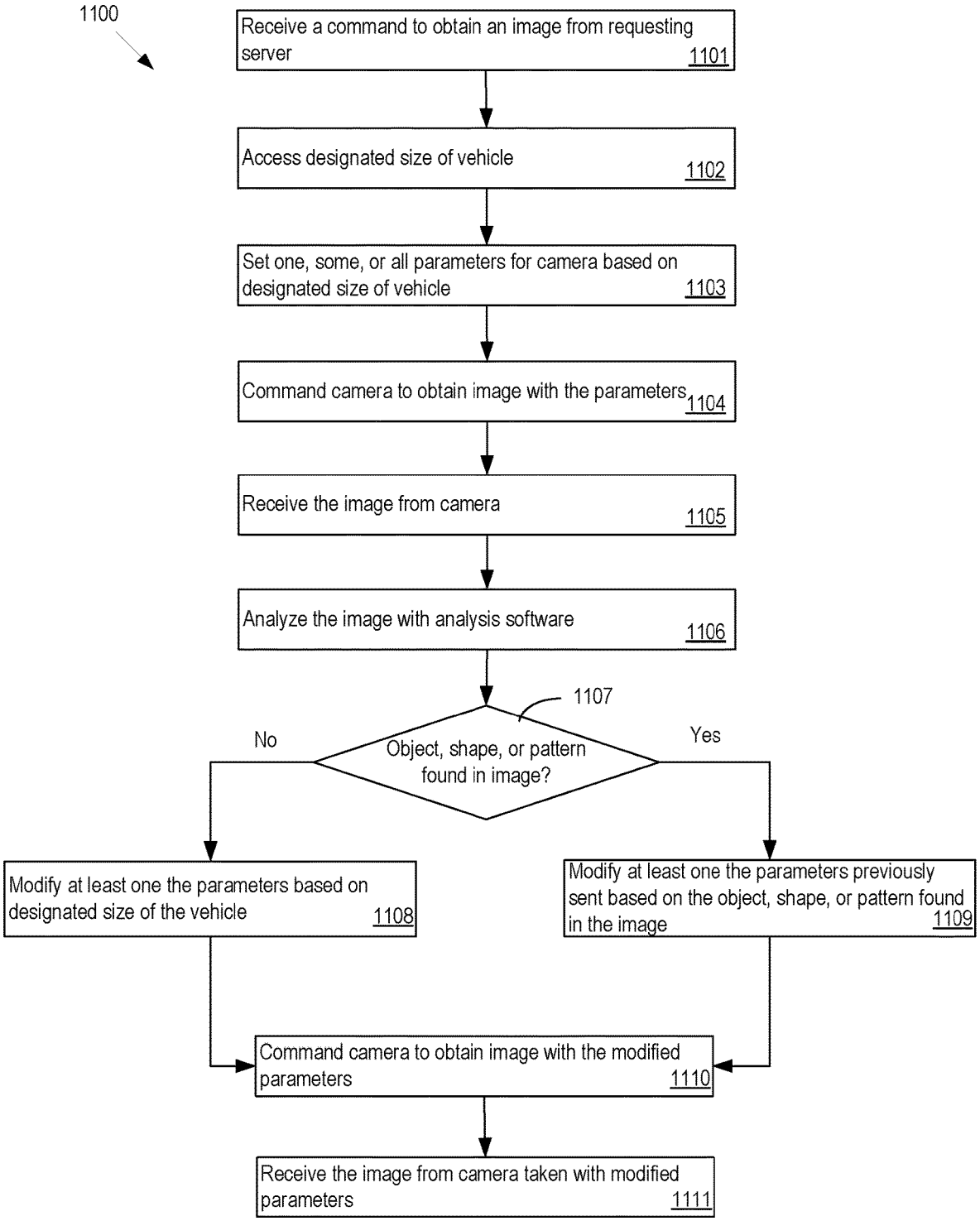
FIG. 11 shows another example vehicle documentation generation method.

FIG. 11 shows another example vehicle documentation generation method 1100. At 1101, a command is received to obtain an image from the requesting server. At 1102, the designated size of the vehicle is accessed. As discussed above, the designated size may be determined in one of several ways, such as by using sensors resident in the vehicle documentation system. At 1103, one, some, or all of the parameters of the camera are set based on the designated size of the vehicle. For example, the starting point and Y-direction may be set based on the designated size of the vehicle, as discussed above. Other parameters, such as the X-direction, may be set independent of the designated size of the vehicle. At 1104, the camera is commanded to obtain an image with the set parameters. At 1105, responsive to sending the command to the camera, an image is received.

At 1106, the received image is analyzed with analysis software. As discussed above, the analysis may comprise computer vision analysis configured to identify an object, a shape, and/or a pattern in the image. At 1107, it is determined whether the computer vision analysis resulted in identifying an object, shape, or pattern in the image. If so, at 1109, one of the parameters previously sent to the camera to obtain the image is modified. For example, the parameter, previously selected independent of the designated size of the vehicle, is modified based on the computer vision analysis. In particular, with regard to the X-direction, selected independent of the designated size of the vehicle, is modified in order to center the image on the object/shape/pattern detected (e.g., the wheel). If the object, shape, or pattern in the image is not identified in the image, at 1108, one of the parameters previously sent to the camera to obtain the image is modified based on the designated size of the vehicle. For example, the parameter, previously selected independent of the designated size of the vehicle, is thereafter selected dependent on the designated size of the vehicle. In particular, with regard to the X-direction, previously selected independent of the designated size of the vehicle, is selected dependent on the designated size of the vehicle (e.g., small). At 1110, the camera is commanded to obtain an image with the modified parameters. At 1111, responsive to sending the command to the camera, an image is received.

In one implementation, the vehicle documentation system may be used in order to perform an inspection of the vehicle. An inspector may inspect the vehicle and determine items of interest associated with the vehicle. The inspector may tag the items of interest using a specific type of tag that the vehicle documentation system may recognize. As one example, the tag may comprise a phototarget (or other type of photo tag). A phototarget may comprise an example of a coded target that is a high contrast dot with a pattern around it. The phototarget may be identified automatically by a software program from the images. One example of a phototarget may comprise two forms of coding, such as a RAD target and a non-ringed coded target. The phototarget may include indicia to identify one or more of the following: (1) an indicia to identify that the marking is a phototarget; (2) an indicia to identify a type of item of interest; or (3) an indicia to indicate a beginning or end of the item of interest. For example, the inspector may identify a defect in the vehicle, such as a scratch or a dent in the vehicle. The inspector may place a phototarget with an indicia to indicate that the item of interest is a defect (or more specifically, indicative of a specific type of defect, such as a scratch defect or a dent defect). As another example, the inspector may identify a crack in the windshield. Responsive to identifying the crack in the windshield, the inspector may place a phototarget with an indicia to indicate the crack in the windshield. As yet another example, the inspector may identify an aftermarket item on the vehicle (e.g., an aftermarket wheel cover).

After placing the one or more phototargets on the vehicle, the vehicle may be examined by the vehicle documentation system. Specifically, the vehicle documentation system may take images of the phototargets in order to glean information from the phototargets. The information gleaned may be directly based on analysis of the phototarget and/or may be indirectly based on the phototarget. For example, the vehicle documentation system may analyze the phototarget in order to read the indicia. In the example of a phototarget indicating an aftermarket item on the vehicle, the vehicle documentation system may: identify that the indicia on the phototarget indicates an aftermarket item; and indicate in a report the presence of the aftermarket item and/or the location of the aftermarket item on the vehicle.

As another example, the vehicle documentation system may analyze the phototarget in order to indirectly glean information from the phototarget. As discussed above, the vehicle may have scratches, dents, or the like. Further, the phototarget may identify, via indicia, that a scratch or dent is present adjacent or proximate to the phototarget. Responsive to the vehicle documentation system identifying that the phototarget indicates a defect (whether the indicia generally indicates a defect, or specifically indicates the type of defect), the vehicle documentation system may analyze the portion of the vehicle adjacent or proximate to the phototarget in order to glean additional information regarding the defect. In the instance of a scratch, the vehicle documentation system may analyze the area proximate or adjacent to the phototarget in order to determine a size of the scratch (such as the length of the scratch). In one implementation, the determination as to the size of the scratch may be based on a single phototarget being placed adjacent or proximate to the scratch. In this implementation, the vehicle documentation system, responsive to identifying that the phototarget indicates a defect (such as a scratch), may analyze the area of the vehicle using computer vision in order to identify the size of the scratch. In an alternative implementation, the determination as to the size of the scratch may be based on multiple phototargets (such as two phototargets) being placed by the inspector at opposite ends of the scratch. Because the scratch is sandwiched between the phototargets, the vehicle documentation system may use computer vision in order to determine the size of the scratch. Specifically, the vehicle documentation system may first identify the scratch in the image (being sandwiched between the phototargets), and may thereafter determine the size of the identified scratch. In one instance, the vehicle documentation system may determine the size of the scratch by comparing the length of the scratch (as defined by a number of pixels in the image) with a length of the phototarget (again defined by a number of pixels in the image). The phototarget, being a known size (such as 2 inches) may provide a reference point for the vehicle documentation system to determine the size of the scratch. In the instance of a dent, the vehicle documentation system may analyze the area proximate or adjacent to the phototarget in order to determine a depth of the dent. Similar to scratches, the dent may be identified by a single phototarget, or multiple phototargets.

Separate from the vehicle documentation system using the phototargets to identify items of interest for the vehicle, the vehicle documentation system may digitally remove the phototargets from the images obtained by cameras of the vehicle documentation system. In this way, the vehicle may enter the vehicle documentation system a single time, with the vehicle documentation system performing the analysis of the vehicle (by analyzing the phototargets to locate items of interest) and generating images of the vehicle (by digitally removing the phototargets from the images taken, thereby using the digitally altered images for the potential sale of the vehicle). In this way, the vehicle documentation system may perform both functions (analysis and generation of photos) without requiring two sets of photographs being taken (one set with the phototargets and a second set without the phototargets) or without removing the phototargets from the vehicle prior to exiting the vehicle documentation system.

The methods, devices, processing, and logic described above may be implemented in many different ways and in many different combinations of hardware and software. For example, all or parts of the implementations may be circuitry that includes an instruction processor, such as a Central Processing Unit (CPU), microcontroller, or a microprocessor; an Application Specific Integrated Circuit (ASIC), Programmable Logic Device (PLD), or Field Programmable Gate Array (FPGA); or circuitry that includes discrete logic or other circuit components, including analog circuit components, digital circuit components or both; or any combination thereof. The circuitry may include discrete interconnected hardware components and/or may be combined on a single integrated circuit die, distributed among multiple integrated circuit dies, or implemented in a Multiple Chip Module (MCM) of multiple integrated circuit dies in a common package, as examples.

The circuitry may further include or access instructions for execution by the circuitry. The instructions may be stored in a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium. A product, such as a computer program product, may include a storage medium and instructions stored in or on the medium, and the instructions when executed by the circuitry in a device may cause the device to implement any of the processing described above or illustrated in the drawings.

The implementations may be distributed as circuitry among multiple system components, such as among multiple processors and memories, optionally including multiple distributed processing systems. Parameters, databases, and other data structures may be separately stored and managed, may be incorporated into a single memory or database, may be logically and physically organized in many different ways, and may be implemented in many different ways, including as data structures such as linked lists, hash tables, arrays, records, objects, or implicit storage mechanisms. Programs may be parts (e.g., subroutines) of a single program, separate programs, distributed across several memories and processors, or implemented in many different ways, such as in a library, such as a shared library (e.g., a Dynamic Link Library (DLL)). The DLL, for example, may store instructions that perform any of the processing described above or illustrated in the drawings, when executed by the circuitry.

Various implementations have been specifically described. However, many other implementations are also possible.

What is claimed is:

1. A vehicle documentation booth comprising:

a structure adapted to receive a vehicle;

a remote communication interface configured to communicate with a remote server;

a vehicle documentation booth controller device in communication with the remote communication interface, the vehicle documentation booth controller device comprising an image capture device and a controller, the image capture device configured to capture an image of the vehicle in the structure, the controller configured to control the image capture device, the vehicle documentation booth controller device configured to:

access a size of the vehicle;

determine, based on the size of the vehicle, a first parameter to modify an image of the vehicle in the structure, wherein the first parameter is a first direction;

determine, based on computer vision analysis, a second parameter to modify the image of the vehicle in the structure, wherein the second parameter is a second direction perpendicular to the first direction;

use the first parameter and the second parameter to modify the images of the vehicle in the structure such that the modification of the image is based on both the size of the vehicle and the computer vision analysis; and send the modified images to the remote server.

2. The vehicle documentation booth of claim 1, further comprising one or more sensors in the structure; and wherein the vehicle documentation booth controller device is further configured to:

determine, based on sensor data generated by the one or more sensors, the size of the vehicle.

3. The vehicle documentation booth of claim 1, wherein the first direction comprises a y-direction; and wherein the second direction comprises an x-direction.

4. The vehicle documentation booth of claim 1, wherein the modification of the images comprises cropping the image in the first direction based on the size of the vehicle and cropping the image in the second direction based on the computer vision analysis.

5. The vehicle documentation booth of claim 1, wherein the vehicle documentation booth controller device is configured to:

command the image capture device to send a first image of the vehicle with the first parameter and with another parameter different from the second parameter;

responsive to sending the command to the image capture device to send the first image of the vehicle, receive the first image of the vehicle;

analyze the first image in order to determine the second parameter;

command the image capture device to send a second image of the vehicle with the first parameter and the second parameter; and responsive to sending the command to the image capture device to send the second image of the vehicle, receive the second image of the vehicle.

6. The vehicle documentation booth of claim 5, wherein the vehicle documentation booth is configured to command the image capture device to crop the first image based on the size of the vehicle and independent of the computer vision analysis, and command the image capture device to crop the second image based on the size of the vehicle and based on the computer vision analysis.

7. The vehicle documentation booth of claim 6, wherein the controller is configured to analyze the first image in order to determine the second parameter by:

identifying an object, shape or pattern in the first image; and based on the identification of the object, shape or pattern in the first image, select the second parameter in order to crop the second image.

8. A vehicle documentation booth comprising:

a structure adapted to receive a vehicle;

a remote communication interface configured to communicate with a remote server;

one or more sensor systems distributed within the structure; and a controller in communication with the remote communication interface and the one or more sensor systems, wherein the one or more sensor systems comprise:

a sensor configured to input one or more images of the vehicle at least partly in the structure;

analytical circuitry configured to analyze the one or more images in order to identify at least one aspect of the vehicle;

modification circuitry configured to modify the one or more images in order to center the identified at least one aspect of the vehicle in the one or more images based on the analysis of the analytical circuitry; and transmission circuitry configured to transmit the modified one or more images to the controller, wherein the controller is configured to transmit the modified one or more images to the remote server.

9. The vehicle documentation booth of claim 8, wherein the modification circuitry is configured to crop the one or more images based on the analysis of the analytical circuitry.

10. The vehicle documentation booth of claim 9, wherein the at least one aspect comprises at least one object of the vehicle; and wherein the modification circuitry is configured to crop the one or more images based on the analysis of the analytical circuitry by centering the identified at least one object of the vehicle in the one or more images.

11. The vehicle documentation booth of claim 8, wherein the at least one aspect comprises a shape of the vehicle.

12. The vehicle documentation booth of claim 8, wherein the at least one aspect comprises a pattern.

13. A vehicle documentation booth comprising:

a structure adapted to receive a vehicle;

a remote communication interface configured to communicate with a remote server;

one or more sensor systems distributed within the structure; and a controller in communication with the remote communication interface and the one or more sensor systems, wherein the one or more sensor systems comprise:

a sensor configured to input one or more images of the vehicle at least partly in the structure;

analytical circuitry configured to analyze the one or more images for an object;

modification circuitry configured to modify the one or more images based on the analysis of the analytical circuitry; and transmission circuitry configured to transmit the modified one or more images to the controller, wherein the controller is configured to transmit the modified one or more images to the remote server;

wherein the analytical circuitry is configured to generate an error in response to failing to identify the object in the one or more images; and wherein the transmission circuitry is configured to transmit a different image to the controller in response to the analytical circuitry generating an error.

14. The vehicle documentation booth of claim 13, wherein the different image transmitted to the controller has a different field of view than the modified one or more images transmitted to the controller.

15. The vehicle documentation booth of claim 14, further comprising sensor control circuitry configured to control one or more parameters of the sensor;

wherein the sensor control circuitry is configured to control the sensor so that an entire field of view in at least one direction is captured by the sensor; and wherein, in response to the analytical circuitry generating an error, the sensor control circuitry is configured to control the sensor to capture a more narrow field of view based on a size of the vehicle.

16. A vehicle documentation booth comprising:

a structure adapted to receive a vehicle;

a remote communication interface configured to communicate with a remote server; and controller and sensor circuitry in communication with the remote communication interface and configured to:

input one or more images of the vehicle at least partly in the structure;

identify an object, a shape or a pattern in the one or more images;

in response to identifying the object, the shape or the pattern in the one or more images:

modification circuitry configured to modify the one or more images based on the identified object, the identified shape or the identified pattern in the one or more images; and transmission circuitry configured to transmit the modified one or more images to the controller, in response to failing to identify the object, the shape or the pattern in the one or more images:

transmission circuitry configured to transmit an image different from the modified one or more images to the controller.

17. The vehicle documentation booth of claim 16, wherein the different image transmitted to the controller has a different field of view than the modified one or more images transmitted to the controller.

18. The vehicle documentation booth of claim 17, wherein the controller and sensor circuitry comprises analytical circuitry configured to identify the object, the shape or the pattern in the one or more images and sensor circuitry configured to input the one or more images;

further comprising sensor control circuitry configured to control one or more parameters of the sensor circuitry;

wherein the sensor control circuitry is configured to control the sensor so that an entire frame image is captured by the sensor; and wherein, in response to the analytical circuitry failing to identify the object, the shape or the pattern in the one or more images, the sensor control circuitry is configured to control the sensor circuitry to capture a more narrow field of view based on a size of the vehicle.

19. The vehicle documentation booth of claim 18, wherein, in response to failing to identify the object, the shape or the pattern based on the performed edge detection, controlling the sensor to capture the more narrow field of view based on a size of the vehicle.

20. The vehicle documentation booth of claim 19, wherein the modification circuitry is configured to crop the one or more images based on the identification of the object, the shape or the pattern in the one or more images.

21. The vehicle documentation booth of claim 20, wherein the modification circuitry is configured to center the identified object, the identified shape or the identified pattern in the one or more images.

* * * * *